US006350002B1

(12) United States Patent
Takaoka et al.

(10) Patent No.: US 6,350,002 B1
(45) Date of Patent: Feb. 26, 2002

(54) FOOD STORAGE APPARATUS WITH PARTITION FRAME PARTITIONING FRONT OPENING INTO A PLURALITY OF ACCESS OPENINGS

(75) Inventors: Mitsuyuki Takaoka, Toyoake; Takenobu Sobukawa, Nagoya; Shigekazu Kondo; Hideyuki Anzai, both of Toyoake, all of (JP)

(73) Assignee: Hoshizaki Denki Co., Ltd., Aichi (JP)

( * ) Notice: Subject to any disclaimer, the term of this patent is extended or adjusted under 35 U.S.C. 154(b) by 0 days.

(21) Appl. No.: 09/504,617

(22) Filed: Feb. 15, 2000

(51) Int. Cl.[7] ..... A47B 96/04
(52) U.S. Cl. ..... 312/407; 312/400; 220/592.02
(58) Field of Search ..... 312/400, 401, 312/406, 407, 407.1, 409, 236; 62/440, 447; 220/592.05, 592.02

(56) References Cited

U.S. PATENT DOCUMENTS 997,210 A * 7/1911 Richardson ..... 220/592.02
1,369,338 A * 2/1921 Hillman ..... 312/407.1
1,838,098 A * 12/1931 Holbrook ..... 220/592.02
2,460,469 A * 2/1949 Rifkin et al. ..... 220/592.02 X
4,632,470 A * 12/1986 Jenkins et al. ..... 312/407
5,174,640 A * 12/1992 Kuwahara et al. ..... 312/407

* cited by examiner

*Primary Examiner*—James O. Hansen
(74) *Attorney, Agent, or Firm*—Wenderoth, Lind & Ponack, L.L.P.

(57) ABSTRACT

A storage apparatus such as a refrigerator includes a heat-insulated housing having a storage compartment defined by a ceiling, a bottom, two side walls, and a rear wall and a front opening, and a partition frame including a horizontal frame and a vertical frame and mounted on the heat-insulated housing so as to partition the front opening into a plurality of access openings, the access openings having doors respectively. The horizontal frame is formed into a single member fixed to both side walls of the heat-insulated housing so as to extend between them. The vertical frame is formed so as to extend between the ceiling of the heat-insulated housing and the horizontal frame and/or between the bottom of the heat-insulated housing and the horizontal frame.

18 Claims, 22 Drawing Sheets

FOOD STORAGE APPARATUS WITH PARTITION FRAME PARTITIONING FRONT OPENING INTO A PLURALITY OF ACCESS OPENINGS

BACKGROUND OF THE INVENTION

1. Field of the Invention

This invention relates generally to a storage apparatus such as refrigerators, and more particularly to an improvement in the structure of a partition frame mounted in a front opening of the body of such a storage apparatus.

2. Description of the Prior Art

Conventional household four-door refrigerators comprise a body including a heat-insulated housing with a front opening. The interior of the heat-insulated housing serves as storage compartments. Across-shaped partition frame is set in the front opening of the heat-insulated housing so that four access openings are defined. Four heat-insulated doors are hingedly mounted on the heat-insulated housing.

The aforesaid partition frame comprises a single vertical frame and two horizontal frames. Japanese Utility Model Publication No. 5-17585 discloses one of the above-described partition frames. More specifically, a vertical frame extends between an upper edge and a lower edge of the front opening, and the two horizontal frames are mounted between right-hand and left-hand side edges of the opening and the vertical frame respectively. In this construction, the vertical frame serves to reinforce the front opening in the case where a machine compartment is provided on a ceiling of the body such that the ceiling is subjected to load.

Taller and heavier articles are often stored in industrial use refrigerators, which are installed in shops or stores, than in the household refrigerators. For example, when a heavy article such as a dozen encased bottles of beer is put into the storage compartment, the article is held in the operator's arms and placed on the horizontal frame with a considerable impact. Thereafter, the article is pushed into the storage compartment. Accordingly, there is a possibility of the conventional structure being insufficient in strength relative to the applied load because the horizontal frames are mounted between the right-hand and left-hand side edges of the opening and the vertical frame respectively.

SUMMARY OF THE INVENTION

Therefore, an object of the present invention is to provide a storage apparatus in which the partition frame fitted in the front opening has improved strength.

The present invention provides a storage apparatus comprising a heat-insulated housing having a storage compartment defined therein by a ceiling, a bottom, two side walls, a rear wall and a front opening. A partition frame includes a horizontal frame and a vertical frame and is mounted on the heat-insulated housing so as to partition the front opening into a plurality of access openings. The access openings are provided with doors, respectively. In the apparatus, the horizontal frame is formed into a single member fixed to both side walls of the heat-insulated housing so as to extend therebetween. Further, the vertical frame is formed so as to extend between the ceiling of the heat-insulated housing and the horizontal frame and/or between the bottom of the heat-insulated housing and the horizontal frame.

According to the above-described construction, the strength of the horizontal frame is improved since it is formed as a single member. Further, the strength of the horizontal frame against the load applied thereto from above can be improved since the vertical frame is mounted on the middle of the horizontal frame.

In a preferred form, two of the vertical frames are provided so as to extend from the horizontal frame upward and downward respectively, and the storage apparatus further comprises a single back plate secured to the vertical frames so as to extend over both vertical frames. When the vertical frames are subjected to the load of a rack provided in the storage compartment, for example, the load is dispersed to both vertical frames such that the strength of each vertical frame can be improved.

In another preferred form, the storage apparatus further comprises a reinforcement member mounted on a junction between the horizontal and vertical frames. Consequently, the strength of the horizontal frame against the load applied thereto from above can further be improved.

Further, in another preferred form, the reinforcement member has a plurality of mounting holes used to mount the doors for the respective access openings. When mounted on the partition frame side, for example, the door can be mounted readily and stably since the mounting holes are formed in the reinforcement.

BRIEF DESCRIPTION OF THE DRAWINGS

Other objects, features and advantages will become clear upon reviewing the following description of the preferred embodiment, made with reference to the accompanying drawings, in which.

DETAILED DESCRIPTION OF THE PREFERRED EMBODIMENT

Figure 1:
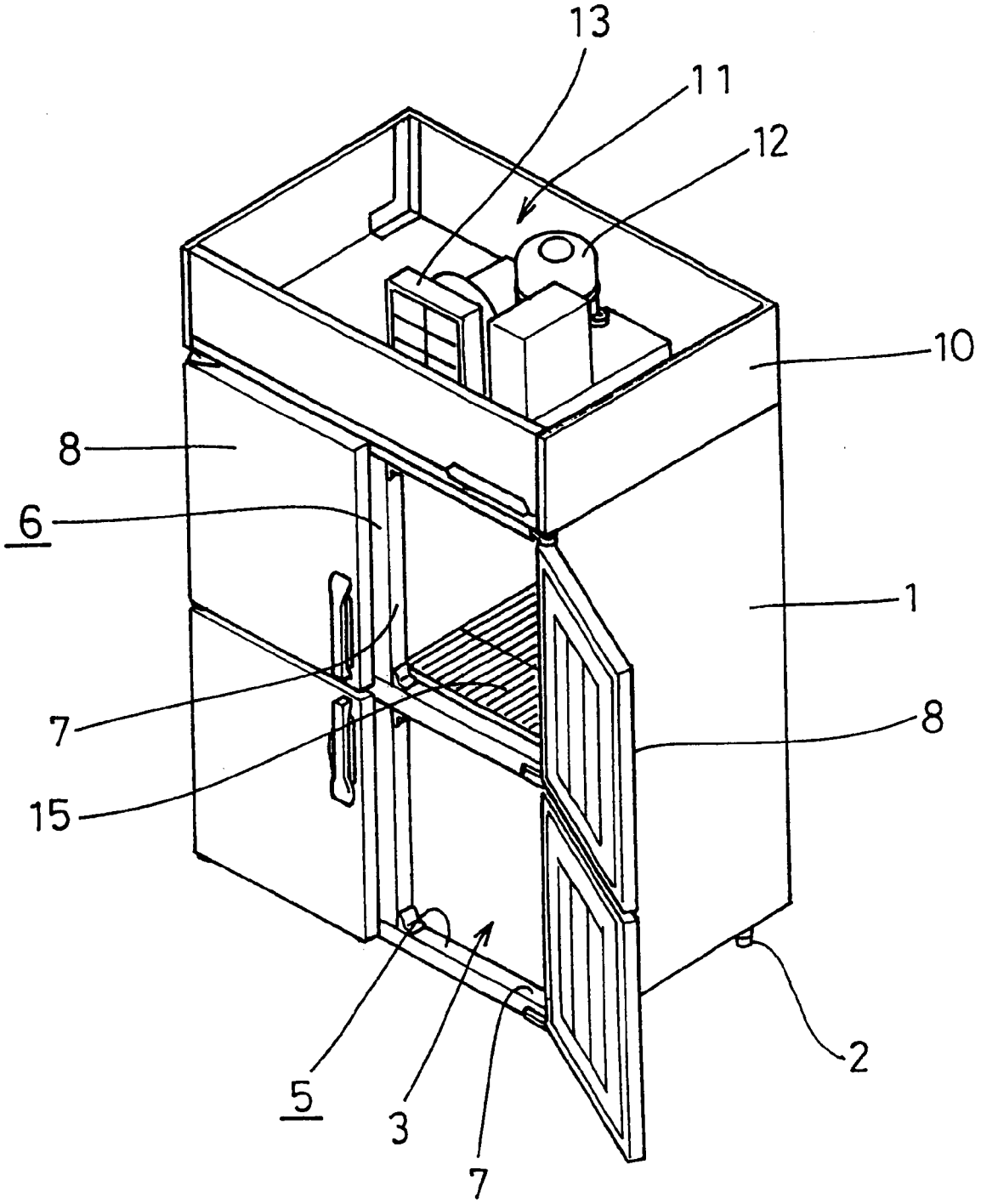
FIG. 1 is a perspective view of a refrigerator embodying the present invention.
Figure 18:
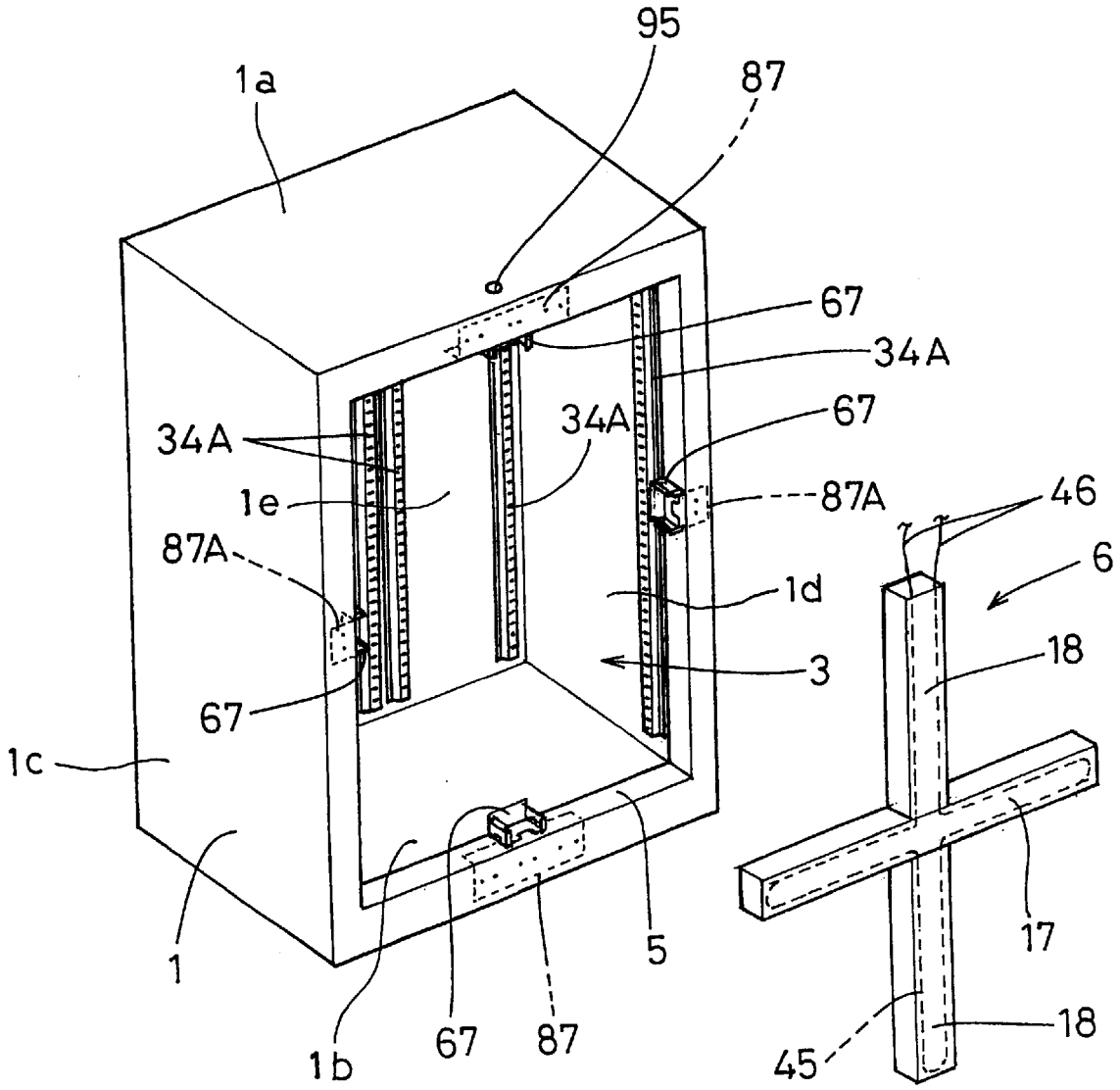
FIG. 18 is a schematic perspective view of the heat-insulated housing and the partition frame, showing the condition before the frame is mounted on the housing.

One embodiment of the present invention will be described with reference to the accompanying drawings. Referring to FIG. 1 and FIG. 18, the overall construction of a refrigerator embodying the invention is shown. The refrigerator comprises a body or heat-insulating housing 1 including a ceiling 1*a*, a bottom 1*b*, two side walls 1*c* and 1*d*, and a rear wall 1*e*. The heat-insulated housing comprises an inner box and an outer box with a heat-insulating material such as a foaming urethane resin filling a space defined between the boxes. Four legs 2, one of which is shown in FIG. 1, are mounted on four corners of a bottom plate of the body 1 respectively to support the body. The interior of the body 1 serves as a storage compartment. The body 1 has a front opening 5 in which a cross-shaped partition frame 6 is mounted to partition the opening into four access openings 7 arranged in two rows each of which includes two access openings. In each row, two biparting doors 8 are mounted on the body 1 so as to close and open the respective access openings 7.

Referring further to FIG. 1, a machine compartment 10 is provided on the top of the body 1. A refrigeration unit 11 including a compressor 12, a condenser 13, etc. is provided in the machine compartment 10. The refrigeration unit 10 is connected by a refrigerant pipe to an evaporator (not shown) provided on a ceiling wall of the storage compartment 3, whereupon a well-known refrigerating cycle is constituted. The refrigeration unit 11 is controlled so that the temperature in the storage compartment 3 is maintained substantially at a predetermined value. The heat-insulated doors 8 can be opened so that articles can be placed onto and removed out from a rack 15 in the storage compartment 3.

Figure 2:
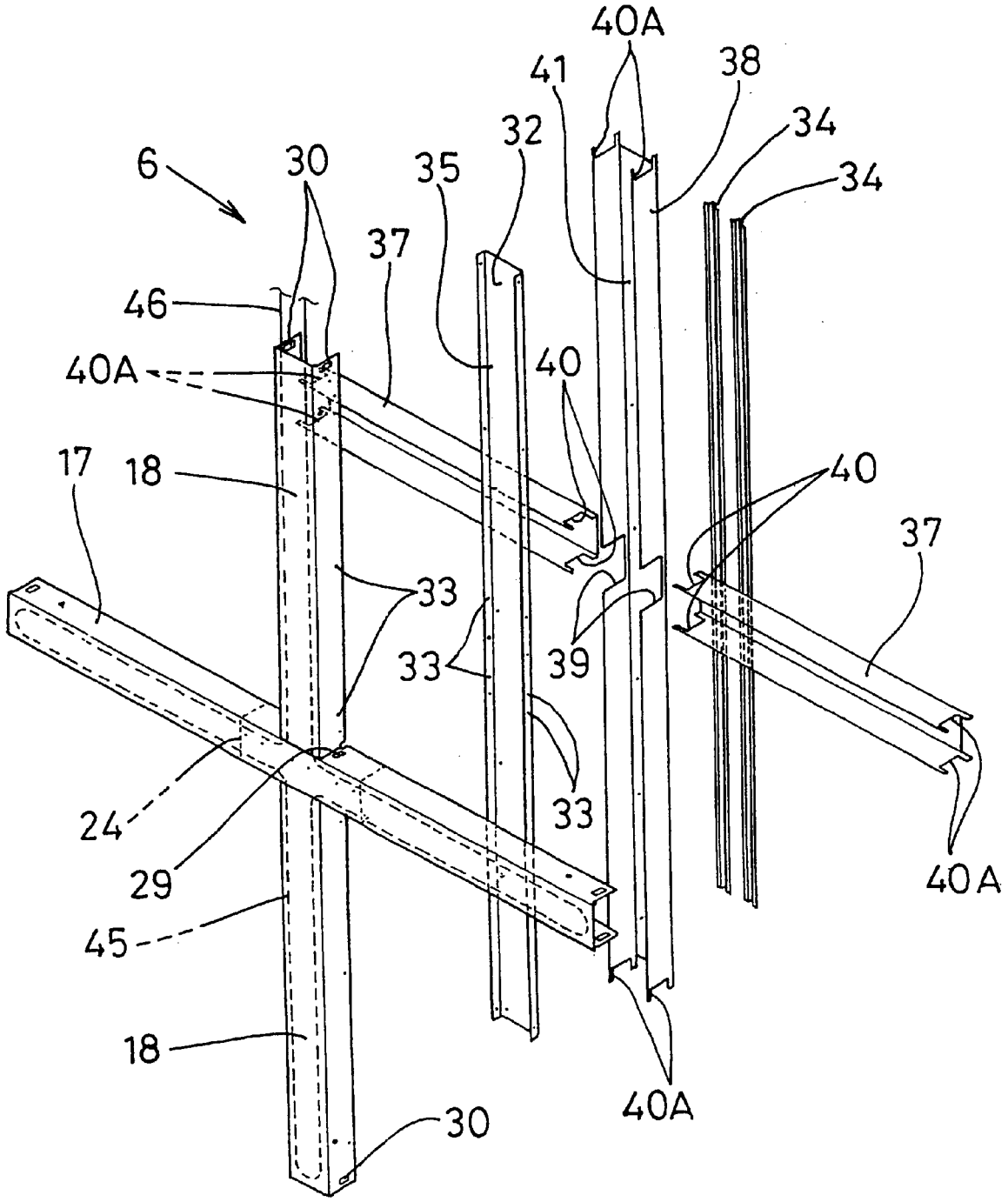
FIG. 2 is an exploded perspective view of the partition frame.
Figure 3:
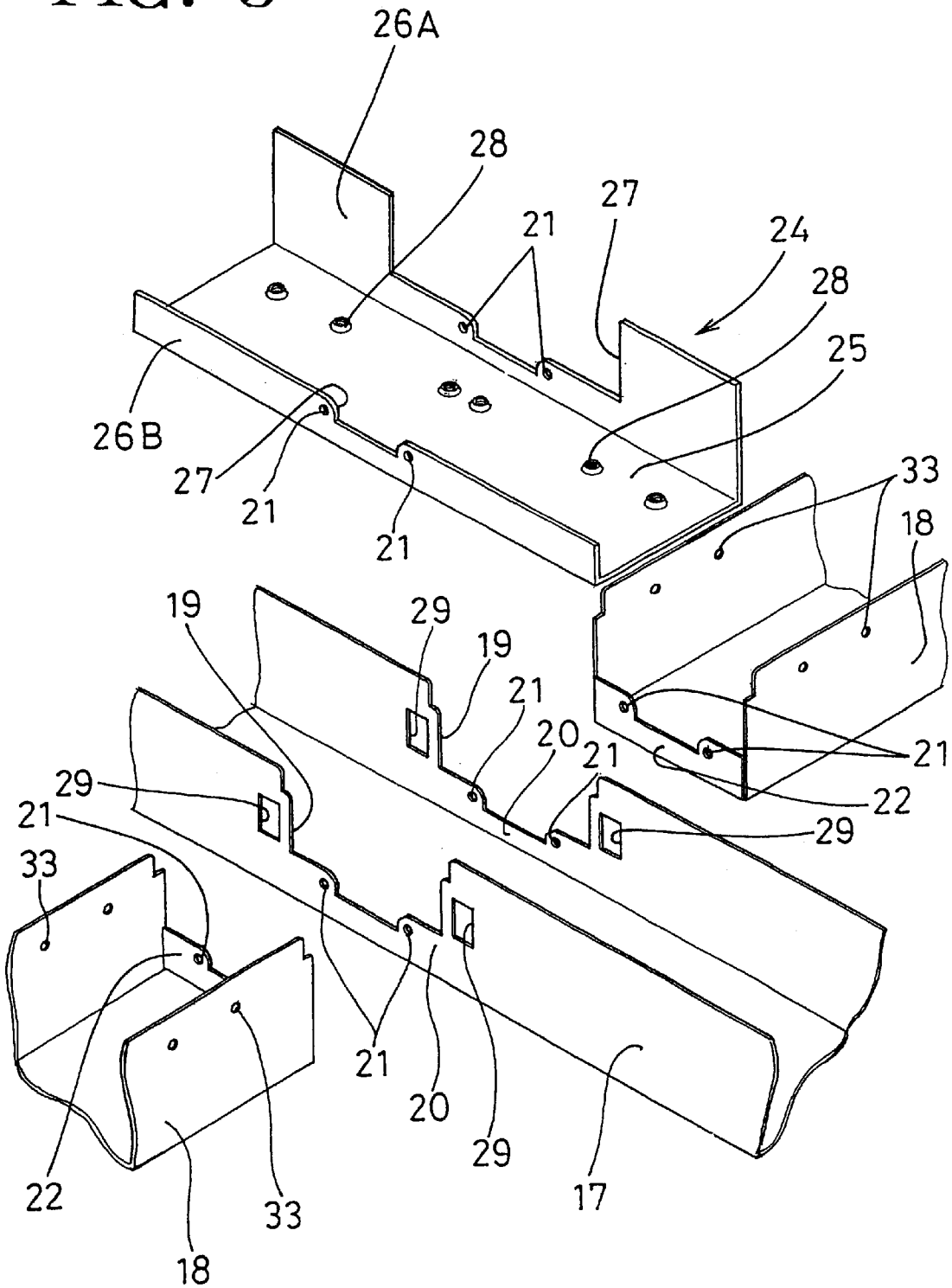
FIG. 3 is a partial exploded perspective view of the horizontal and vertical frames, showing the mounting structure of the frames.

The partition frame 6 and a mounting structure therefor will now be described. The partition frame 6 comprises a single horizontal frame 17 and two vertical frames 18 as shown in FIG. 2. The horizontal frame 17 is made of a stainless steel plate into the shape of a channel. The horizontal frame 17 has a length substantially equal to a horizontal dimension of the opening 5 of the body 1. The horizontal frame 17 includes two opposite side plates having notches 19 at lengthwise central portions thereof respectively as shown in FIG. 3. Each notch 19 has a width reduced in three stages downward from an upper edge of the respective side plate. Each notch 19 includes a deepest portion serving as an abutting portion 20. Each side plate of the horizontal frame 17 has two rivet holes 21 formed at both sides of the deepest portion of the notch 19.

Each vertical frame 18 is also made of a stainless steel plate formed into the shape of a channel. The vertical frames 18 are mounted to lengthwise middle upper and lower portions of the horizontal frame 17 so that the partition frame 6 is formed in the shape of a cross. A dimension between an upper end of the upper vertical frame 18 and a lower end of the lower vertical frame 18 is substantially equal to the height of the opening 5 of the body 1. Each vertical frame 18 has an abutting portion 22 formed by bending the end mounted to the horizontal frame 17 at right angles. Each abutting portion 22 is abutted against the abutting portion 20 of the horizontal frame 17. Each abutting portion 22 has two rivet holes 21 corresponding to those of the respective abutting portion 20 of the horizontal frame 17.

Figure 7:
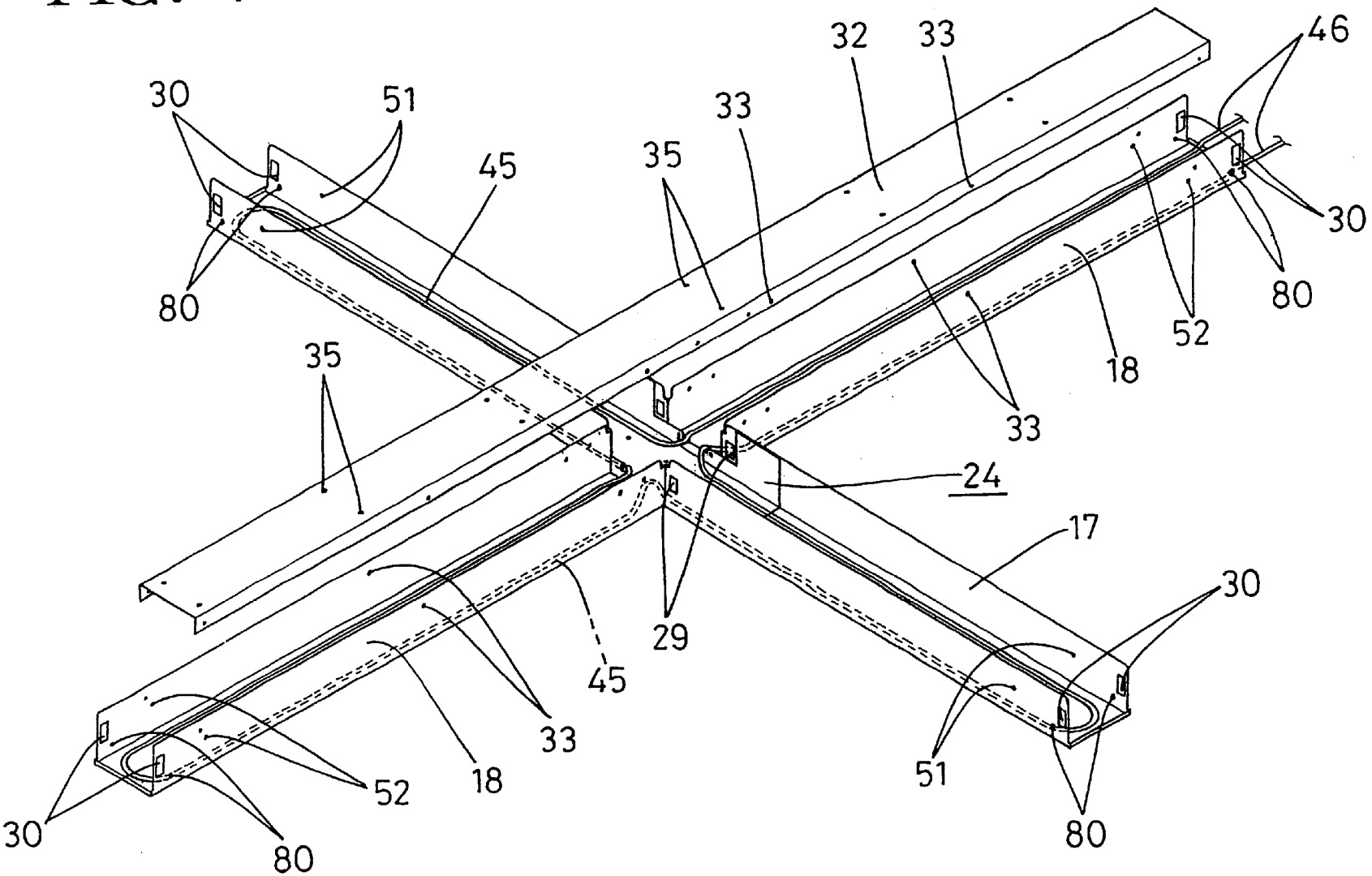
FIG. 7 is an exploded perspective view of the back plate, showing the mounting structure thereof.

The horizontal frame 17 has two generally rectangular locking holes 29 formed in each of the opposite side walls thereof so as to be positioned at both sides of the middle of the corresponding notch 19. These holes 29 are used to mount corner covers 54 as will be described later. The horizontal frame 17 further has two generally rectangular escape holes 30 formed in the upper and lower side plates thereof respectively as shown in FIG. 7. The upper vertical frame 18 also has two escape holes 30 formed in the upper ends of the right-hand and left-hand side plates thereof respectively. The lower vertical frame 18 also has two escape holes 30 formed in the right-hand and left-hand side plates thereof respectively. All of these escape holes 30 are required when the corner covers 54 are mounted.

Figure 4:
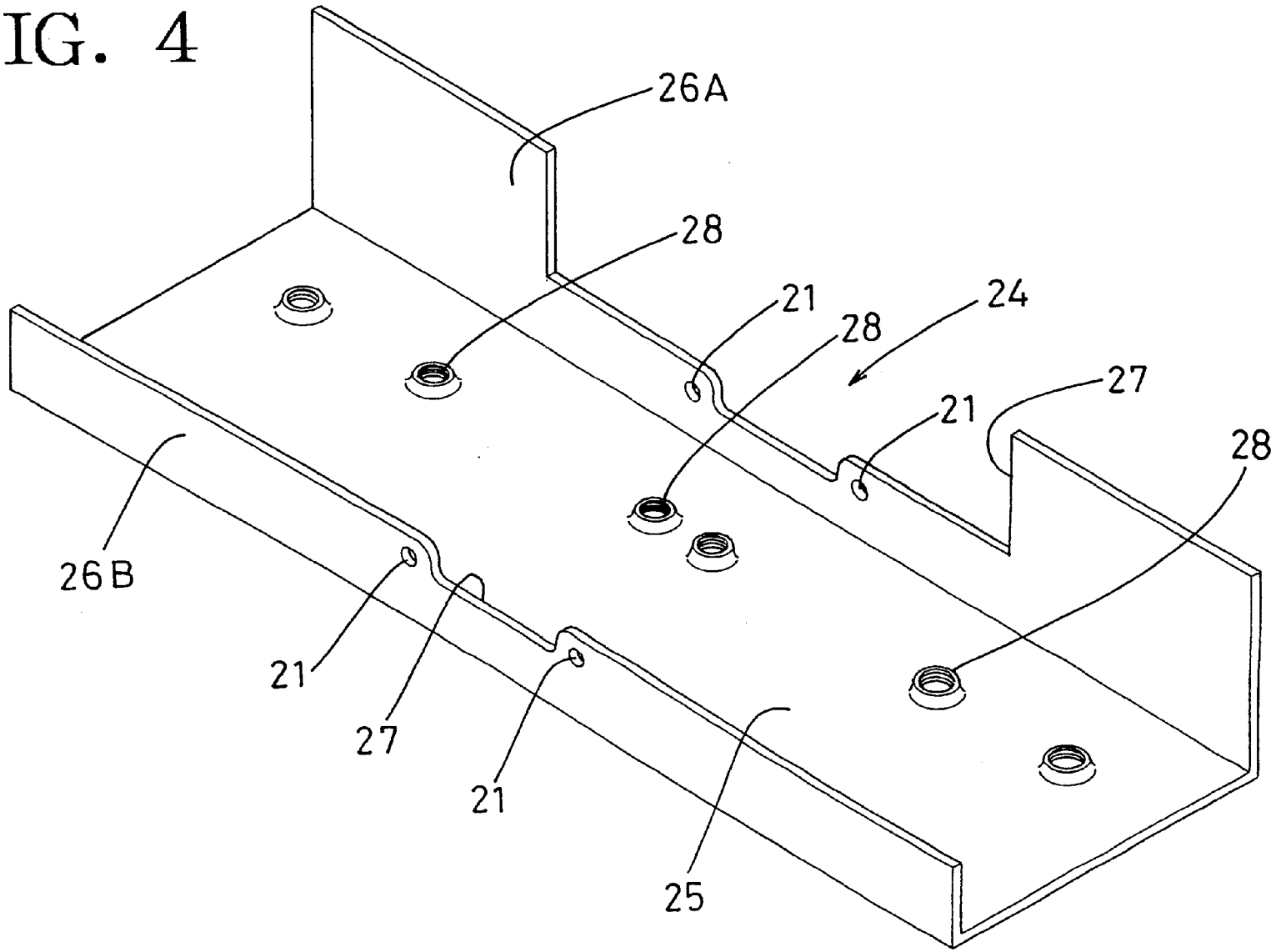
FIG. 4 is a perspective view of the reinforcing plate at the partition frame side.
Figure 5:
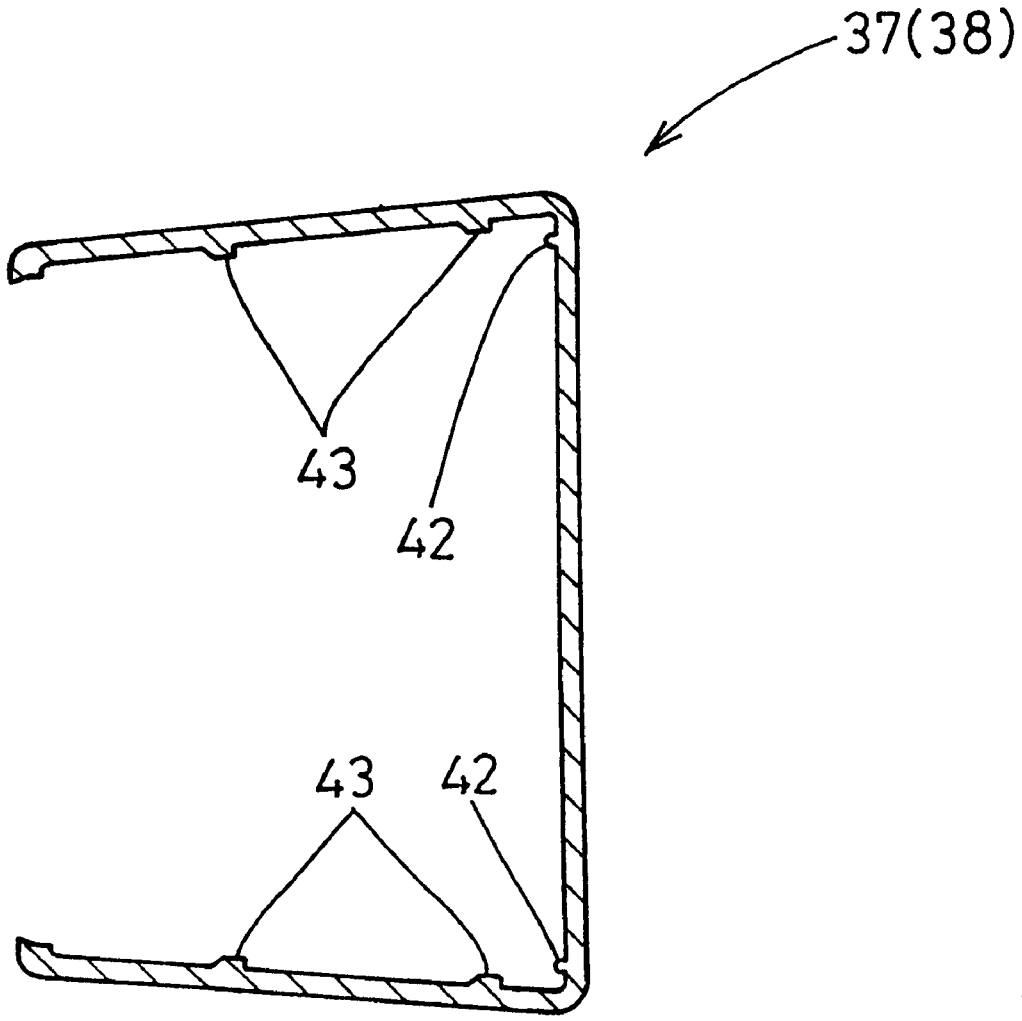
FIG. 5 is a sectional view of the decorative frame.

A reinforcing plate 24 is attached to a lengthwise central portion of the horizontal frame 17 as shown in FIG. 3. The reinforcing plate 24 is made by pressing a thick metal plate. As shown in FIG. 4, the reinforcing plate 24 includes a base 25 and two side plates 26A and 26B raised from both side edges of the base 25 respectively. The reinforcing plate 24 has such a width as to be tightly fitted in the horizontal frame 17. The upper side plate 26A has a height that is slightly smaller than the depth of the horizontal frame 17. The lower side plate 26B is as high as the abutting portion 20 of the horizontal frame 17. Each of the side plates 26A and 26B has a notch 27 formed in the lengthwise central portion thereof The notch 27 of the higher side plate 26A has a width reduced in two stages. The side plate 26A has two rivet holes 21 formed at both sides of the lowest and narrowest portion thereof respectively. The lower side plate 26B also has two rivet holes 21 formed at both sides of the notch 27 thereof respectively. The rivet holes 21 of the reinforcing plate 24 correspond to those of the horizontal plate 17 and the vertical frames 18 respectively. The base 25 of the reinforcing plate 24 has three pairs of cylindrical portions knocked out at the backside thereof Two pairs are formed in both ends of the base 25 respectively and the other is formed in the lengthwise central portion thereof The cylindrical portions are formed with screw holes 28 respectively.

Referring to FIG. 2 again, a back plate 32 is made of a metal and in the shape of a shallow channel. The back plate 32 is secured to the backs of the above-described vertical frames 18. More specifically, the back plate 32 is fitted with the backs of the vertical frames 18 except the upper end of the upper vertical frame 18 and the lower end of the lower vertical frame 18, extending over the back openings of the vertical frames 18 mounted on the horizontal frame 17. The back plate 32 includes two opposite side plates formed with suitably located rivet holes 33 respectively. The side plates of each vertical frame 18 also have respective rivet holes 33 formed to correspond to those of the back plate 32. The back plate 32 further includes a base having two columns of screw holes 35 formed therein so as to be spaced away from one another lengthwise.

A decorative frame is attached to the backs of the horizontal and vertical frames 17 and 18. The decorative frame comprises a single vertical decorative frame 38 and two horizontal frames 37. Each of the decorative frames 37 and 38 is made of a synthetic resin so as to have a generally C-shaped section. The vertical decorative frame 38, has a length substantially equal to the dimension between the upper edge of the upper vertical frame 18 and the lower edge of the lower vertical frame 18, both of which vertical frames 18 are assembled to the horizontal frame 17. The vertical decorative frame 38 has two opposite side plates formed with centrally located notch-like escape recesses 39 respectively. The horizontal frame 17 is fitted in the escape holes 39. Each horizontal decorative frame 37 has a length substantially equal to the length of a portion of the corresponding horizontal frame 17 projecting from the vertical frame 18. Each of the decorative frames 37 and 38 is formed so that the open side thereof is slightly closed, whereupon each decorative frame can elastically be fitted with the backside of the horizontal or vertical frame 17 or 18. The base of each of the decorative frames 37 and 38 has two lengthwise extending ribs 42, whereas each side plate of each decorative frame has two lengthwise extending ribs 43.

Each horizontal decorative frame 37 has two escape holes 40 formed in inner ends of both side plates thereof respectively. The escape holes 40 correspond to the holes 29 of the horizontal frame 17 respectively. Further, each horizontal decorative frame 37 has two escape holes 40A formed in outer ends of both side plates thereof respectively. The vertical decorative frame 38 also has two escape holes 40A formed in the upper ends of both side plates thereof respectively and two escape holes 40A formed in the lower ends of both side plates thereof respectively. These escape holes 40A correspond to the escape holes 30 of the horizontal and vertical frames 17 and 18 respectively. The vertical decorative frame 38 includes a base formed with insertion holes 41 for screws 63 respectively. The insertion holes 41 are formed so as to correspond to the screw holes 35 of the back plate 32 respectively.

Figure 6:
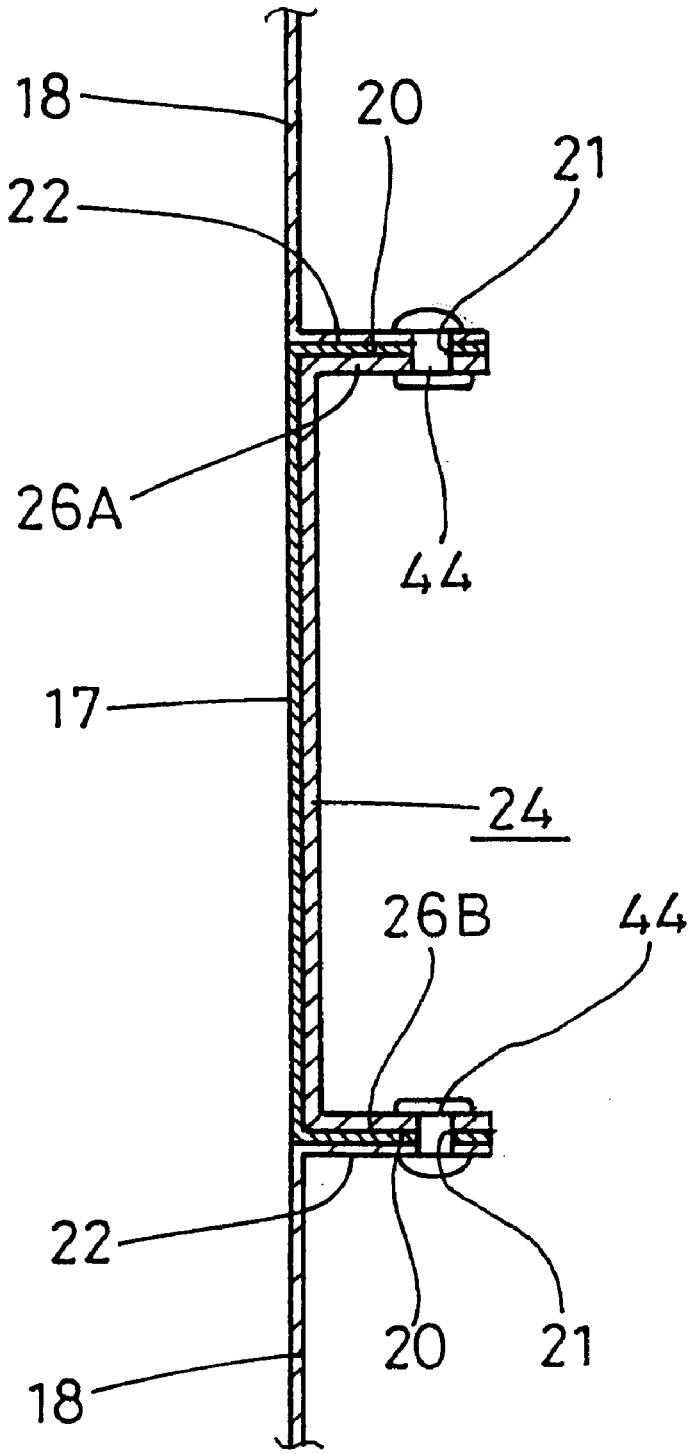
FIG. 6 is a sectional view showing the horizontal and vertical frames and the reinforcing plate fixed to the frames.

An assembling sequence of the partition frame 6 will now be described. First, the horizontal frame 17 is placed on a work table with the opening thereof being directed upward as shown in FIG. 3. The reinforcing plate 24 is then fitted into the central portion of the horizontal frame 17 with the opening thereof being directed upward. Next, the abutting portions 22 of the upper and lower vertical frames 18 are put upon the abutting portions 20 of the horizontal frame 17 respectively. The reinforcing plate 24 and the vertical frames 18 are secured to the horizontal frame 17 by rivets 44 screwed through the rivet holes 21 respectively as shown in FIG. 6. There are four points which are secured by the rivets 44, that is, two upper points and two lower points. As a result, as shown in FIG. 7, the single horizontal frame 17 and the two vertical frames 18 are assembled together with the reinforcing plate 24 into the shape of a cross.

Figure 14:
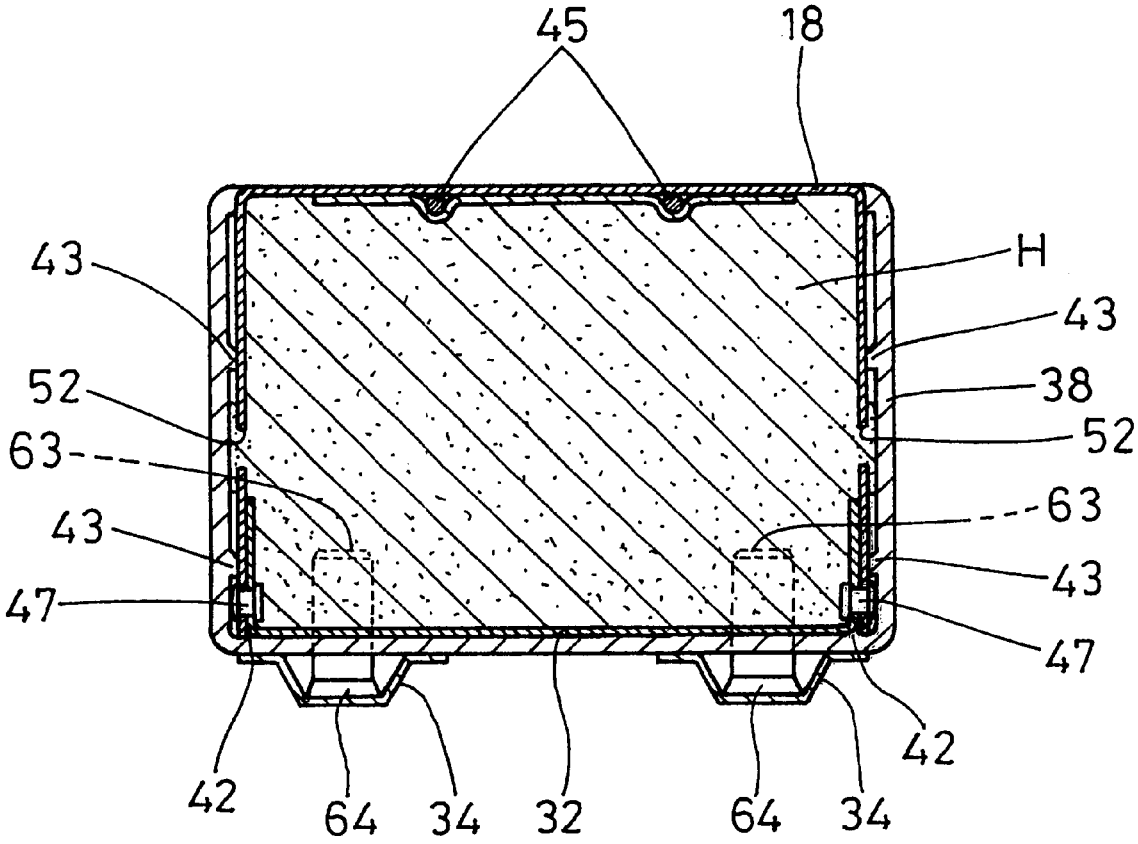
FIG. 14 is a sectional view of the vertical frame.

A heater 45 is wired and pasted along the inside of each vertical frame 18 and the inside of the horizontal frame 17. The heater 45 includes lead wires 46 drawn out of the upper end opening of the upper vertical frame 18. The back plate 32 is then fitted with the inside of each vertical frame 18 so as to extend over both vertical frames. The back plate 32 is positioned so that the base thereof is planar with the open edges of the vertical frames 18. The bases of the overlapped vertical frames and back plate 32 are fixed by rivets 47 as shown in FIGS. 8 and 14.

Figure 8:
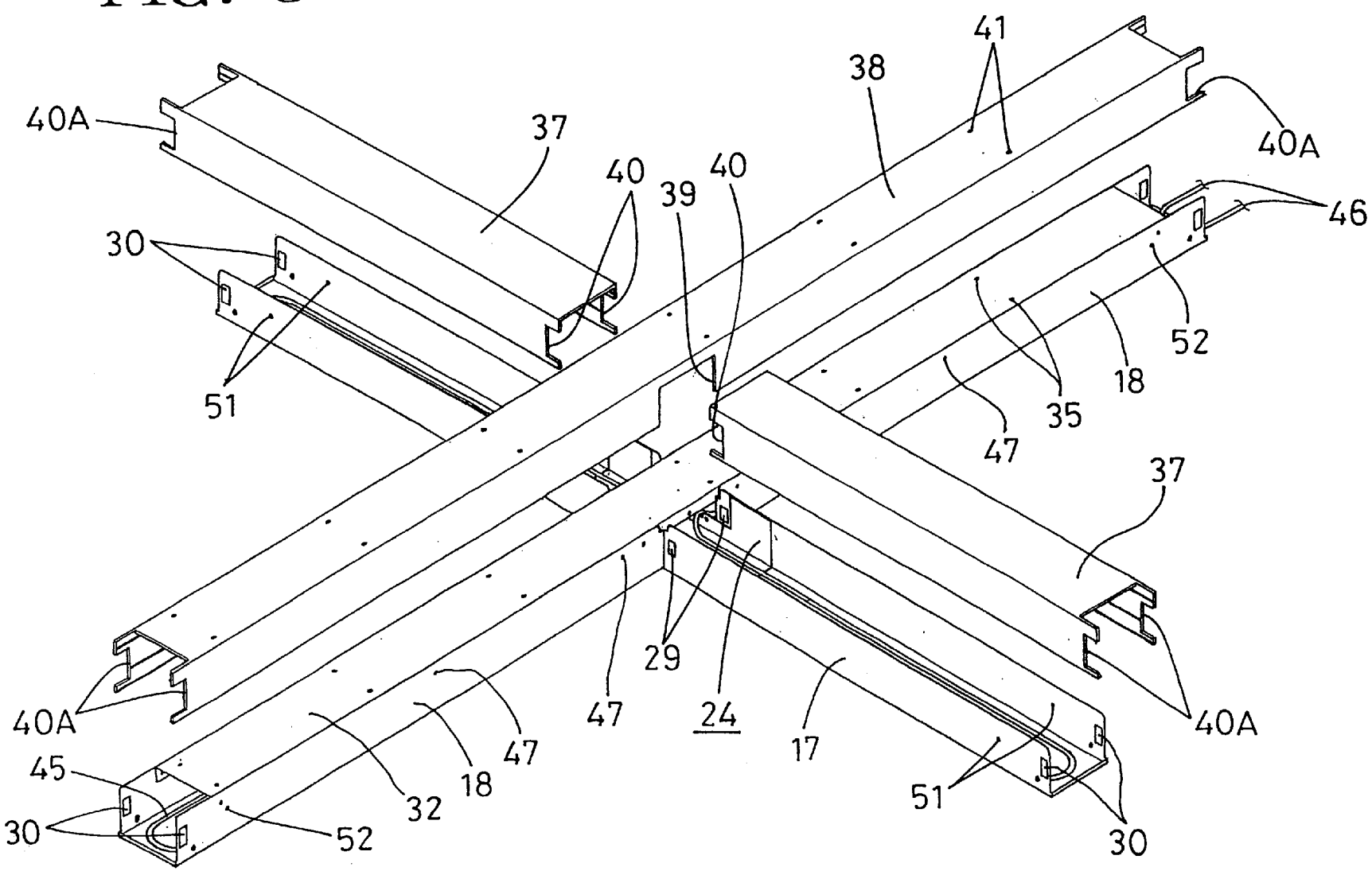
FIG. 8 is an exploded perspective view of the decorative plate, showing the mounting structure thereof.
Figure 9:
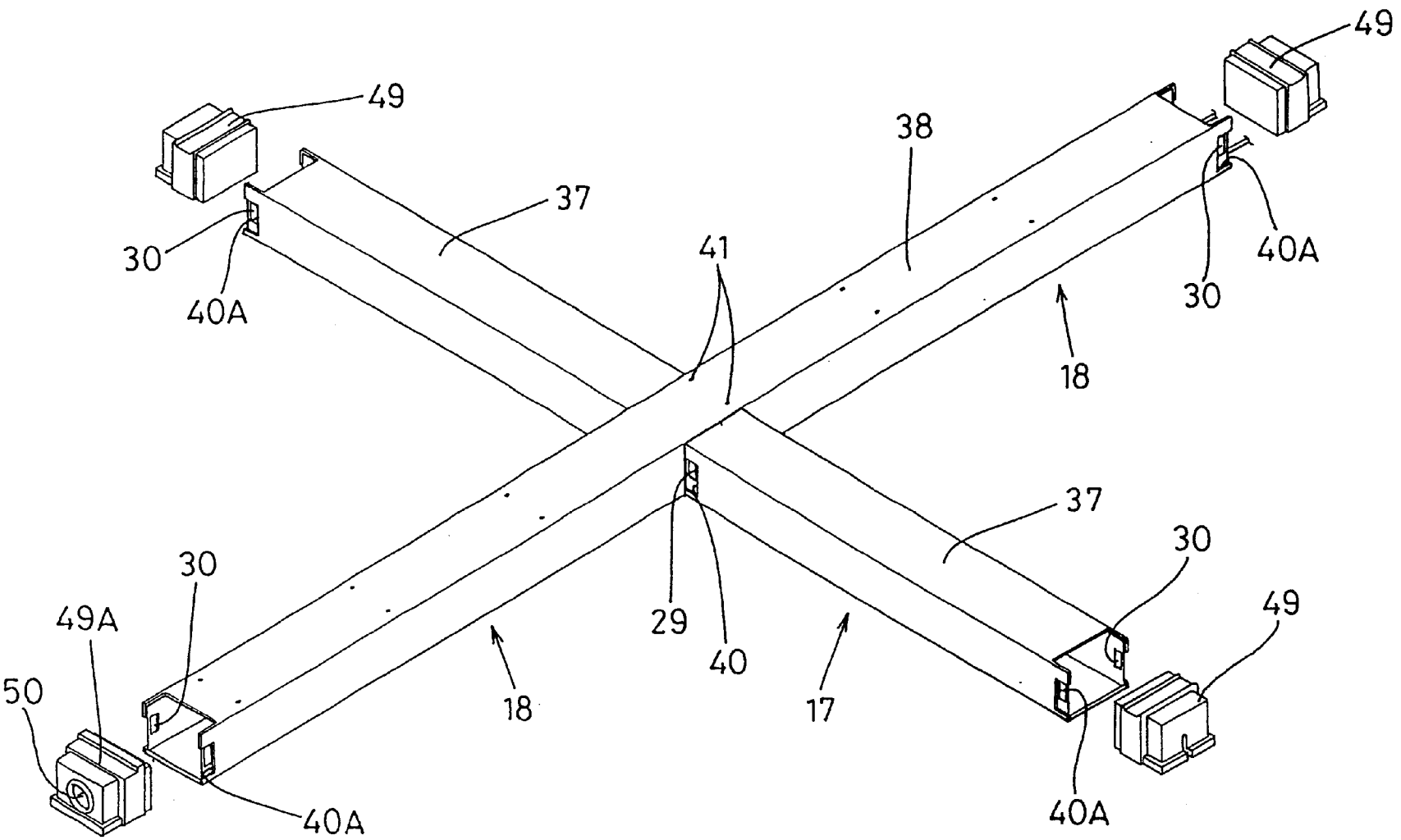
FIG. 9 is an exploded perspective view of the horizontal and vertical frames and plugs fitted with ends of the frames.
Figure 10:
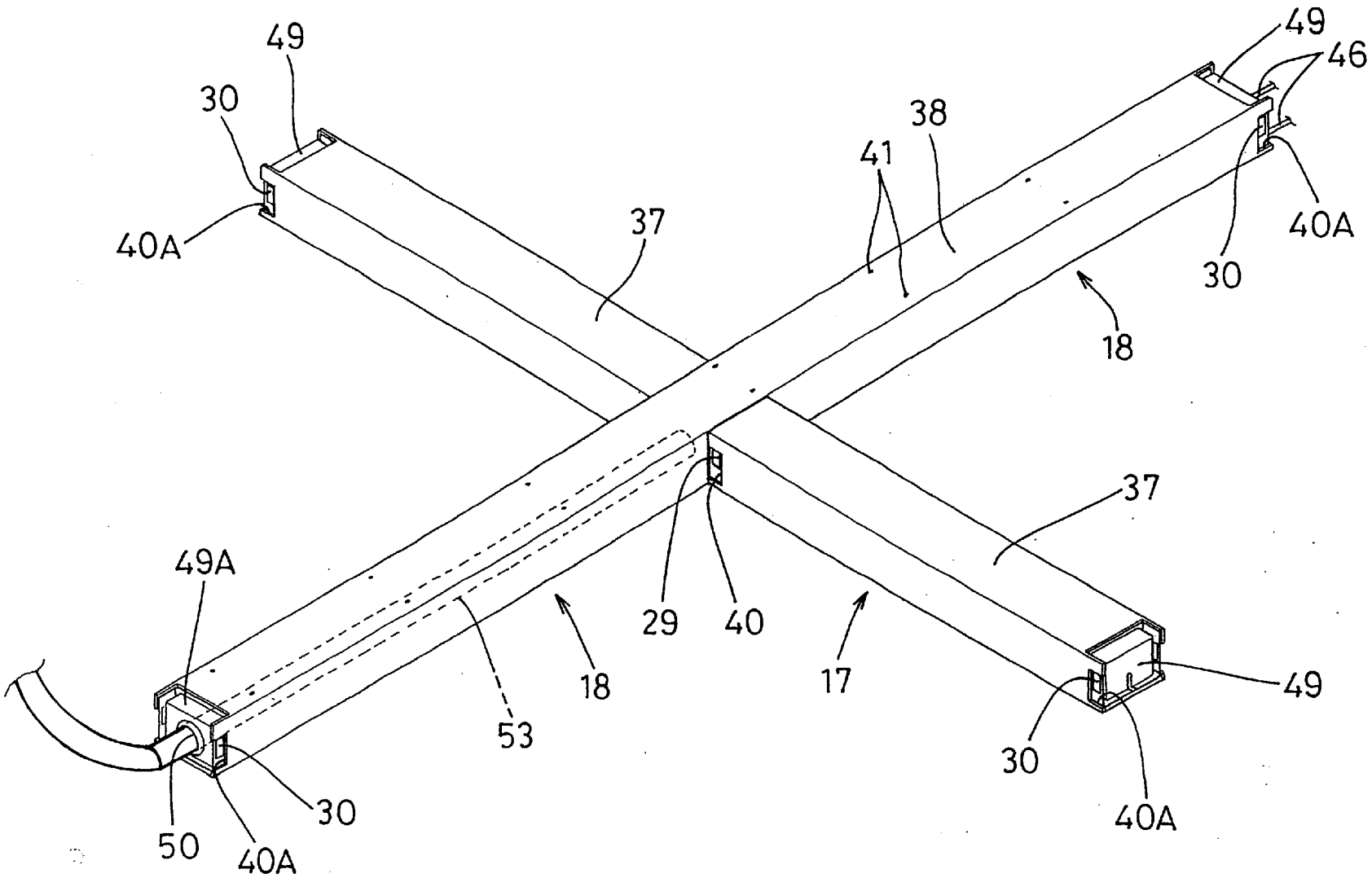
FIG. 10 is a perspective view of the horizontal and vertical frames, showing the step of pouring a foaming material into the interior of the partition frame.

The single vertical decorative frame 38 is then fitted with the vertical frames 18 so as to extend over both of them as shown in FIG. 8. Further, The horizontal decorative frames 37 are fitted with the portions of the horizontal frame projecting from the vertical frames 18 respectively. In this case, the ribs 42 provided on the ends of the base of each horizontal decorative frame 37 are fitted with the right inside of the open edges of both side plates of the horizontal frame 17. Then, as shown in FIG. 9, the plugs 49 each made of foaming styrol plastic are attached to the upper end of the upper vertical frame 18, the lower end of the lower vertical frame 18, and the left-hand and right-hand ends of the horizontal frame 17. The read wires 46 of the heater 45 are caused to extend between the plug 49 and the vertical frame 18 to be drawn out from the upper end of the vertical frame 18 as shown in FIG. 10. The plug 49A attached to the lower end of the vertical frame 18 has a through hole 50 through which a hose 53 extends as will be described later.

Figure 11:
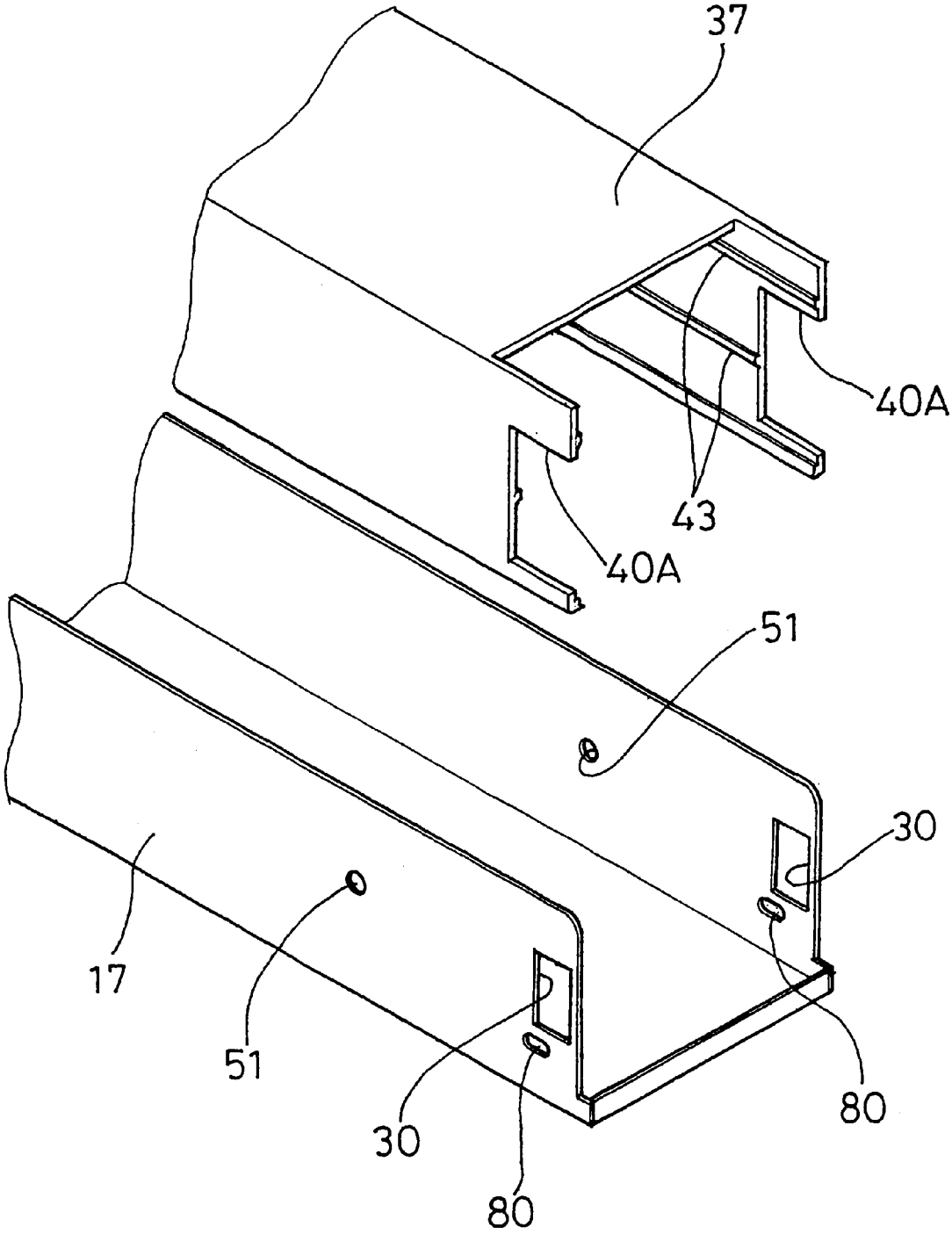
FIG. 11 is a partial exploded view of one end of the horizontal frame.
Figure 12:
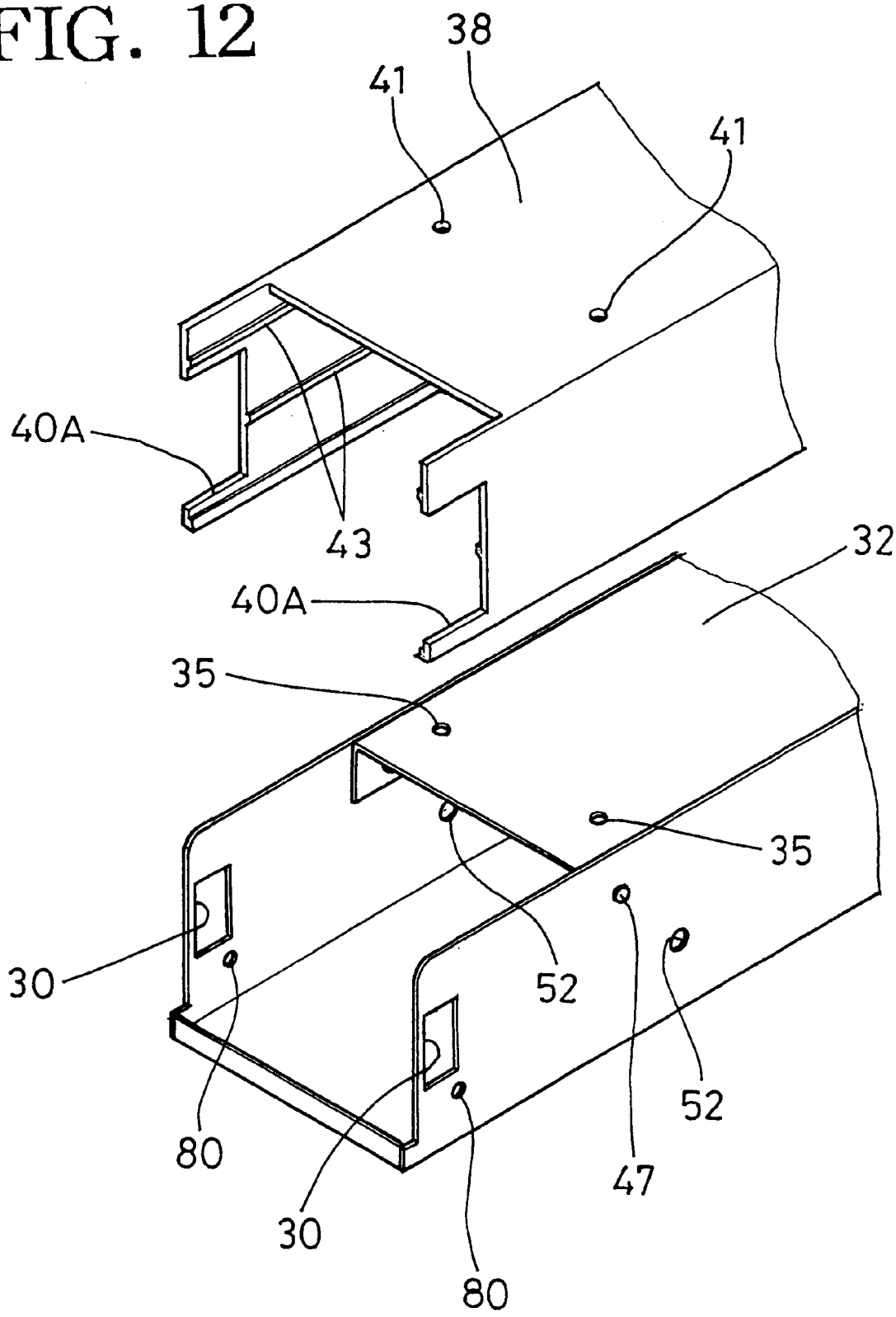
FIG. 12 is a partial exploded view of one end of the vertical frame.
Figure 13:
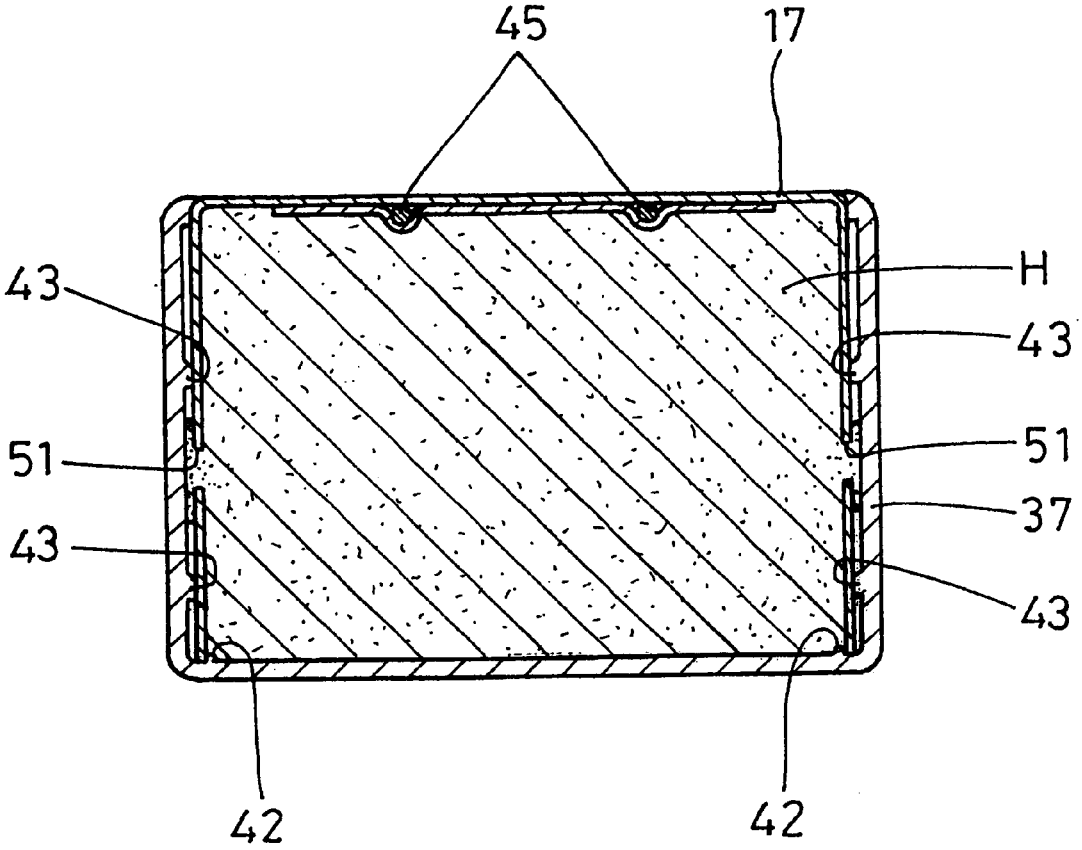
FIG. 13 is a sectional view of the horizontal frame.

The foaming resin H serving as the heat-insulating material is poured into the cross-shaped interior of the partition frame 6 in the above-described assembled state. The horizontal frame 17 has vent holes 51 formed in left-hand and right-hand ends of the upper and lower side plates thereof respectively as shown in FIG. 11. Each vertical frame 18 also has vent holes 52 formed in the upper and lower ends of the left-hand and right-hand side plates thereof respectively as shown in FIG. 12. Each vent hole 51 or 52 is located between the two ribs 43 formed on either side plate of the horizontal or vertical decorative frame 37 or 38 as shown in FIGS. 13 and 14. Each vent hole 51 or 52 has a diameter substantially proportional to the length of the horizontal or vertical frame 17 or 18 respectively. Since the sum of the lengths of the vertical frames 18 is longer than that of the horizontal frame 17 in the embodiment, each of the vent holes 52 of the vertical frames 18 has a larger diameter than each of the vent holes 52 of the horizontal frame 17.

The locking holes 29 etc. are sealed up by a tape and thereafter, the partition frame 6 assembled as described above is placed on a foaming jig (not shown). An injecting hose 53 extending from an injector (not shown) is inserted through the insertion hole 50 of the plug 49A of the lower end of the lower vertical frame 18 as shown in FIG. 10. The hose 53 is inserted into the vertical frame 18 until the distal end thereof reaches the cross-point of the horizontal and vertical frames 17 and 18. An undiluted solution of the foaming material H is poured through the hose 53 into the partition frame 6 under this condition so that the foaming material H is foamed inside the partition frame. The foaming material H is also poured into the upper vertical frame 18 and the horizontal frame 18 in the same manner as described above. Provision of the vent holes 51 and 52 rapidly supplies the foaming material H throughout the interior of the partition frame 6.

The foaming material H is thus supplied into the partition frame 6 toward the distal end while air is let out of the frame. Each vent hole 51 of the horizontal frame 17 having the smaller length than the vertical frames 18 has the smaller diameter than each vent hole 52 of the vertical frames 18. Accordingly, since air vent is limited in the horizontal frame 17, the filling speed is increased. As a result, the foaming material H can fill up the interior of each of the frames 17 and 18 substantially for the same time although the length of the horizontal frame 17 differs from the total length of the vertical frames 18. Further, a small amount of the foaming material H is caused to leak through the vent holes 51 and 52 as shown in FIGS. 13 and 14 so that the foaming material adheres to the decorative frames 37 and 38. Consequently, a securing force of each of the decorative frames 37 and 38 can be increased. The ribs 42 are utilized to cause the resin to leak out in the horizontal frame 17.

Figure 15:
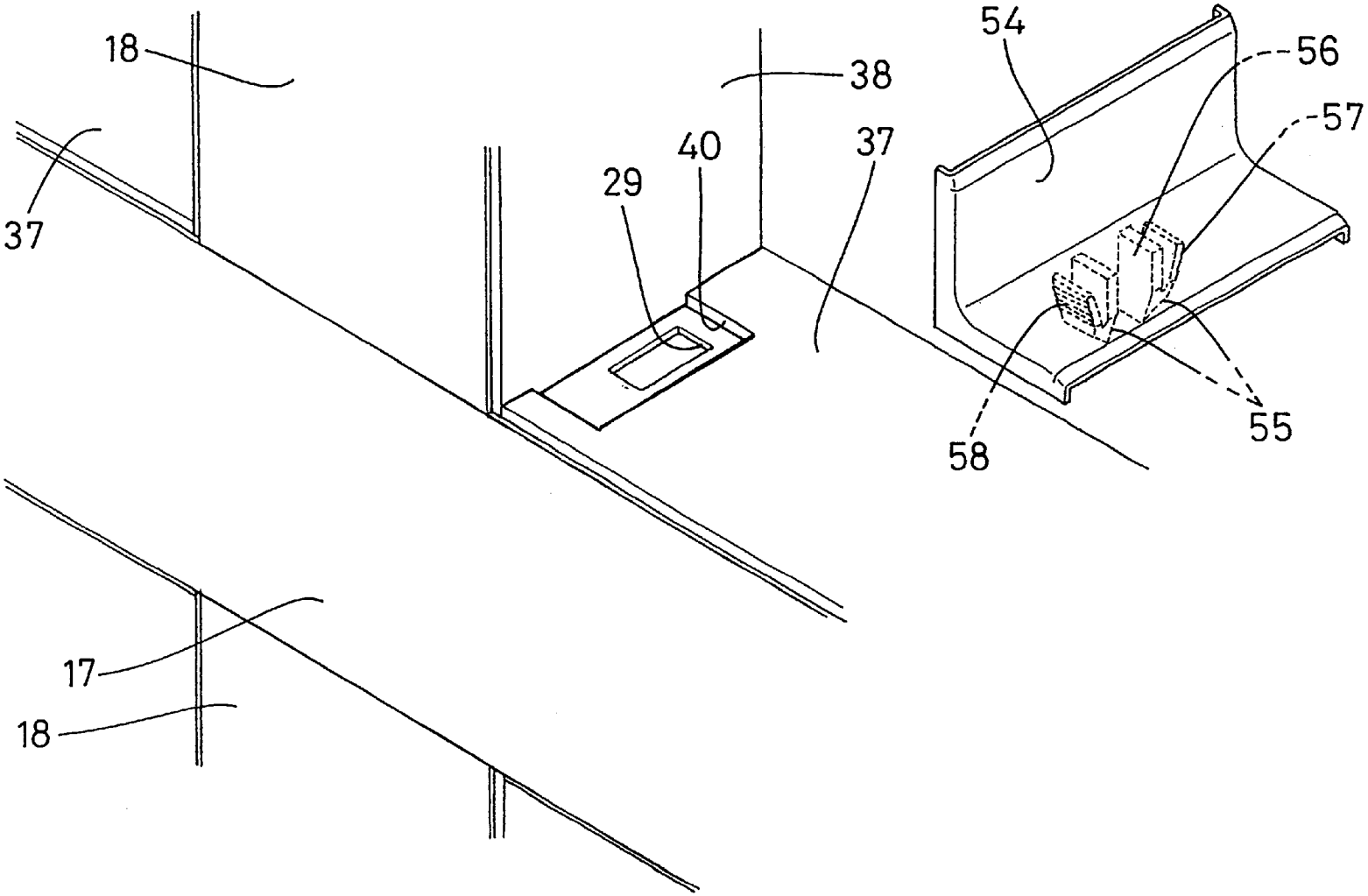
FIG. 15 is a perspective view showing one corner of an access opening and a corner cover.

Upon completion of the foaming of the heat-insulating material in the frame 6, the corner covers 54 are mounted on corners of the frame so that joints of the decorative frames 37 and 38 are concealed. Each corner cover 54 is made of a synthetic resin and has a generally L-shaped section such that the corner cover includes two plate portions, as shown in FIG. 15. The corner cover 54 has a pair of locking protrusions 55 formed on the backside of one of the plate portions thereof. Each locking protrusion 55 includes an insertion body 56 formed to extend from the backside of the plate portion and a flexing piece 57 formed by folding back the distal end thereof to be inclined relative to the insertion body. The flexing piece 57 has a plurality of locking teeth 58 formed on the outer face thereof.

Figure 16:
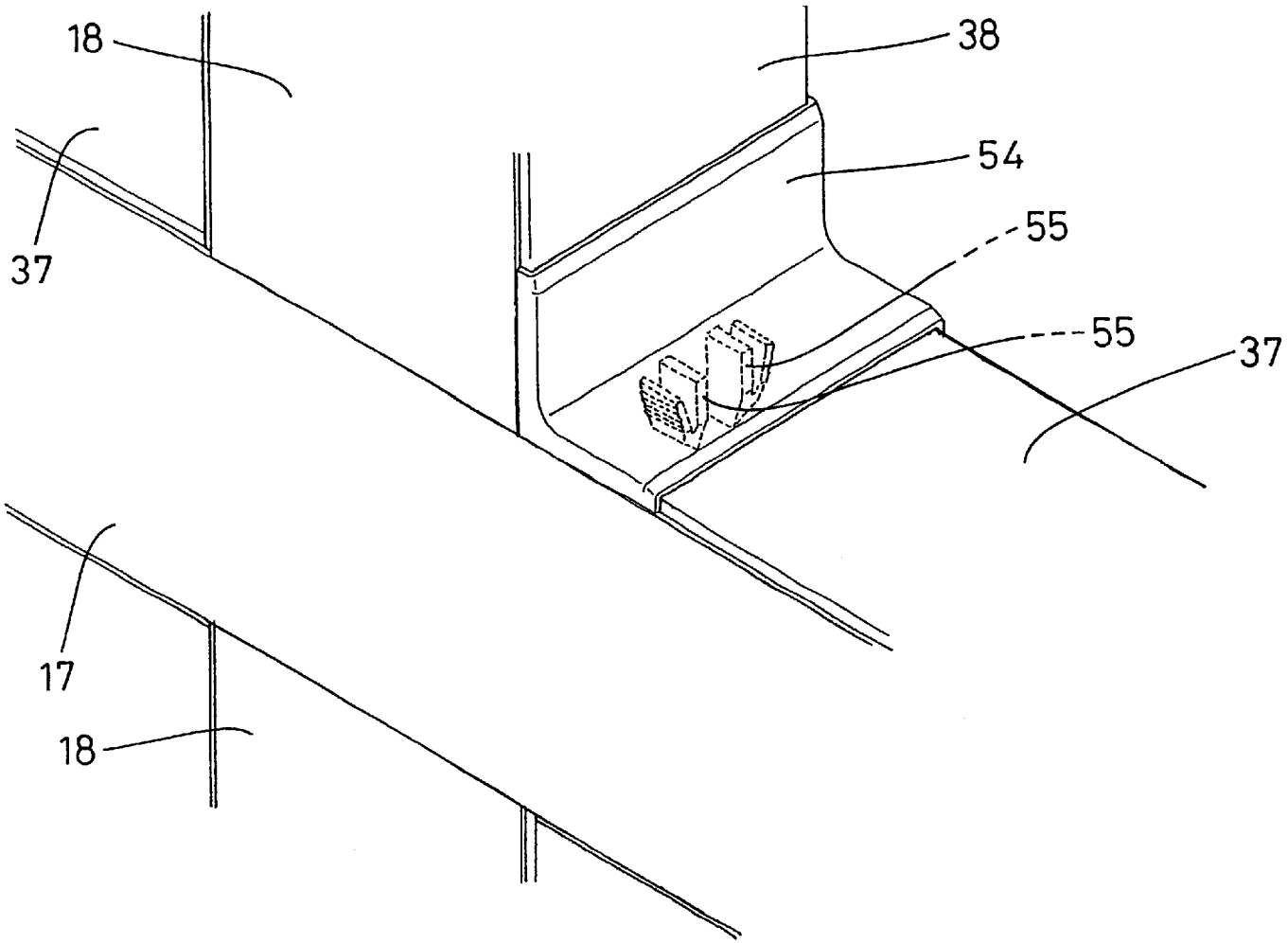
FIG. 16 is a perspective view of the corner cover mounted on the corner.
Figure 17:
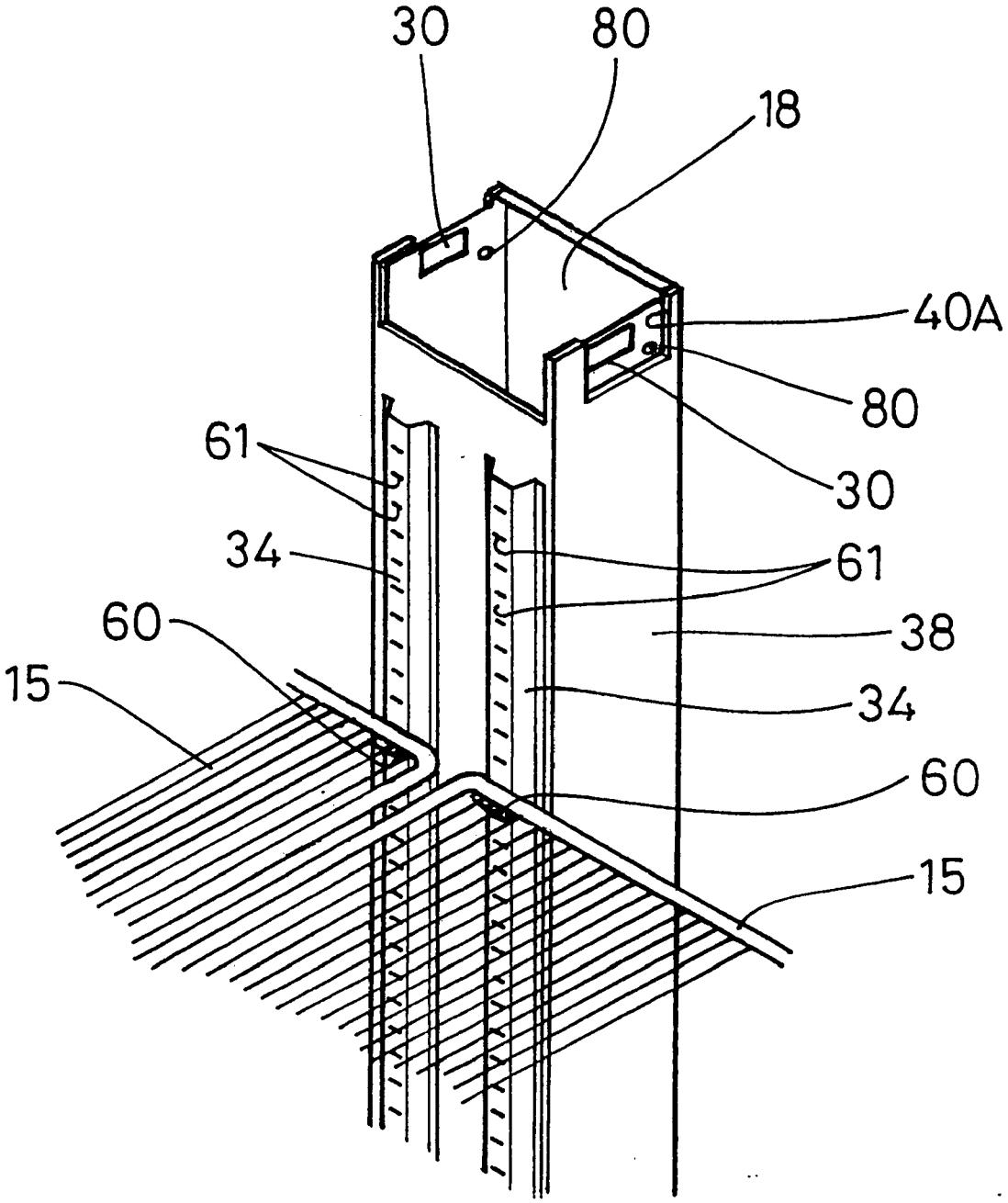
FIG. 17 is a partial perspective view of the vertical frame as viewed at the backside thereof.

A case where the corner cover 54 is mounted on the upper right-hand corner will be described. As shown in FIG. 15, both locking protrusions 55 of the corner cover 54 are inserted through the locking hole 29 of the horizontal frame 17 into the heat-insulating material. The locking teeth 58 of the flexing pieces 57 are engaged with the opposed edges of the locking hole 29 respectively, whereby the corner cover 54 is mounted on the corner as shown in FIG. 16. The corner covers 54 are mounted on the other corners respectively in the same manner as described above. With the mounting of the corner covers 54, rack supports 34 are mounted on the backside of the vertical decorative frame 38. Each rack support 34 is elongated and has a protruding widthwise central portion. The protruding portion of each rack support 34 has a number of mounting holes 61 formed therein at regular intervals. A rack holder 60 is detachably attached to the mounting hole 61 as shown by chain line in FIG. 22. Each rack support 34 has recessed seats 64 for screws 63 respectively as shown in FIG. 14. The two rack supports 34 are abutted against the backside of the vertical decorative plate 38 in parallel with each other. Screws 63 inserted through the seats 64 are screwed through the insertion holes 41 into the screw holes 35 of the back plate 32 respectively so that the rack supports 34 are fixed to the vertical decorative frame 38. The assembly of the partition frame 6 is completed. The partition frame 6 assembled into the cross shape as described above is fitted into the front opening 5 of the refrigerator body 1 from the front to be fixed therein as shown in FIG. 18.

Figure 19:
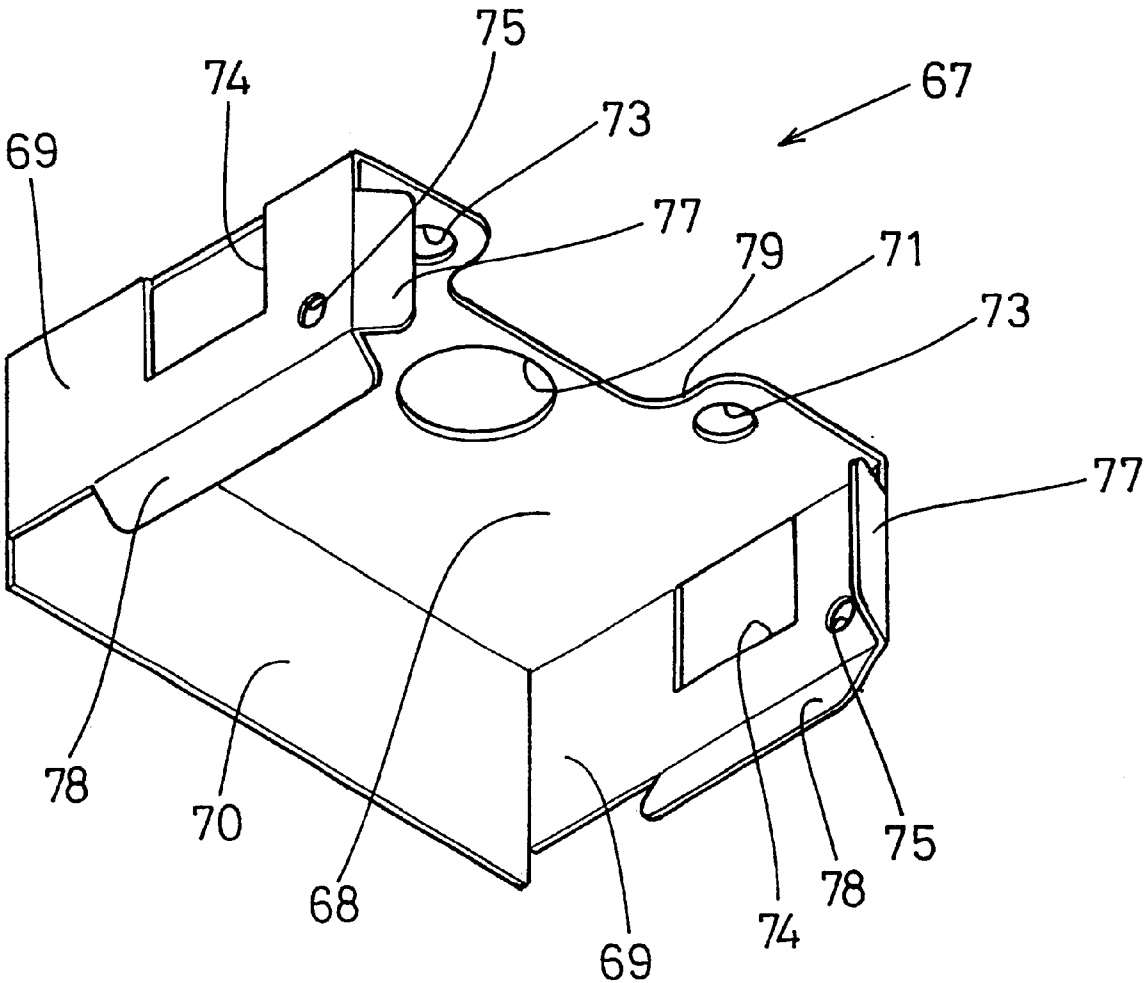
FIG. 19 is a perspective view of a catch.

The mounting structure for the partition frame 6 will now be described. Four catches 67 are provided on the upper, lower, left-hand and right-hand side central front edges of the opening 5 respectively. The projecting ends of the partition frame 6 are fitted with the respective catches 67 to be fixed thereto. Each catch 67 is made by pressing a stainless steel plate. FIG. 19 shows the catch 67 on which the upper vertical frame 18 is mounted, for example. The shown catch includes a mounting plate 68, two side plates 69 formed by bending both side edges at right angles and a rear plate 70 formed by bending a rear edge at right angles. The mounting plate 68 has a notch 71 in a front edge thereof. Two insertion holes 73 through which screws 72 are inserted are formed at opposite sides of the notch 71, respectively. Each side plate 69 has a generally centrally located rectangular locking hole 74 used for the mounting of the corner cover 54 which is the same as described above. Each side plate 69 has a screw hole 75 located lower than the front lower corner of the hole 74. Each side plate 74 further has a first guide 77 extending from the front edge thereof and a second guide 78 extending from the lower edge thereof. The first and second guides 77 and 78 are formed to be slightly bent inward. The mounting plate 68 has a circular through hole 79 located slightly in the rear of the notch 71. The lead wires 46 of the heater 45 are inserted through the hole 79.

The catches 67 which are the same as described above are provided on the upper, left-hand and right-hand front edges of the opening 5 respectively. Actually, however, the circular holes 79 and second guides 78 of the catches 67 of these edges do not have any functions. Both side plates of each of the horizontal and vertical frames 17 and 18 have two insertion holes 80 formed near the escape holes 30 respectively. Screws 96 are inserted through the holes 80 and correspond to the screw holes 75 of the catch 67 respectively.

Figure 20:
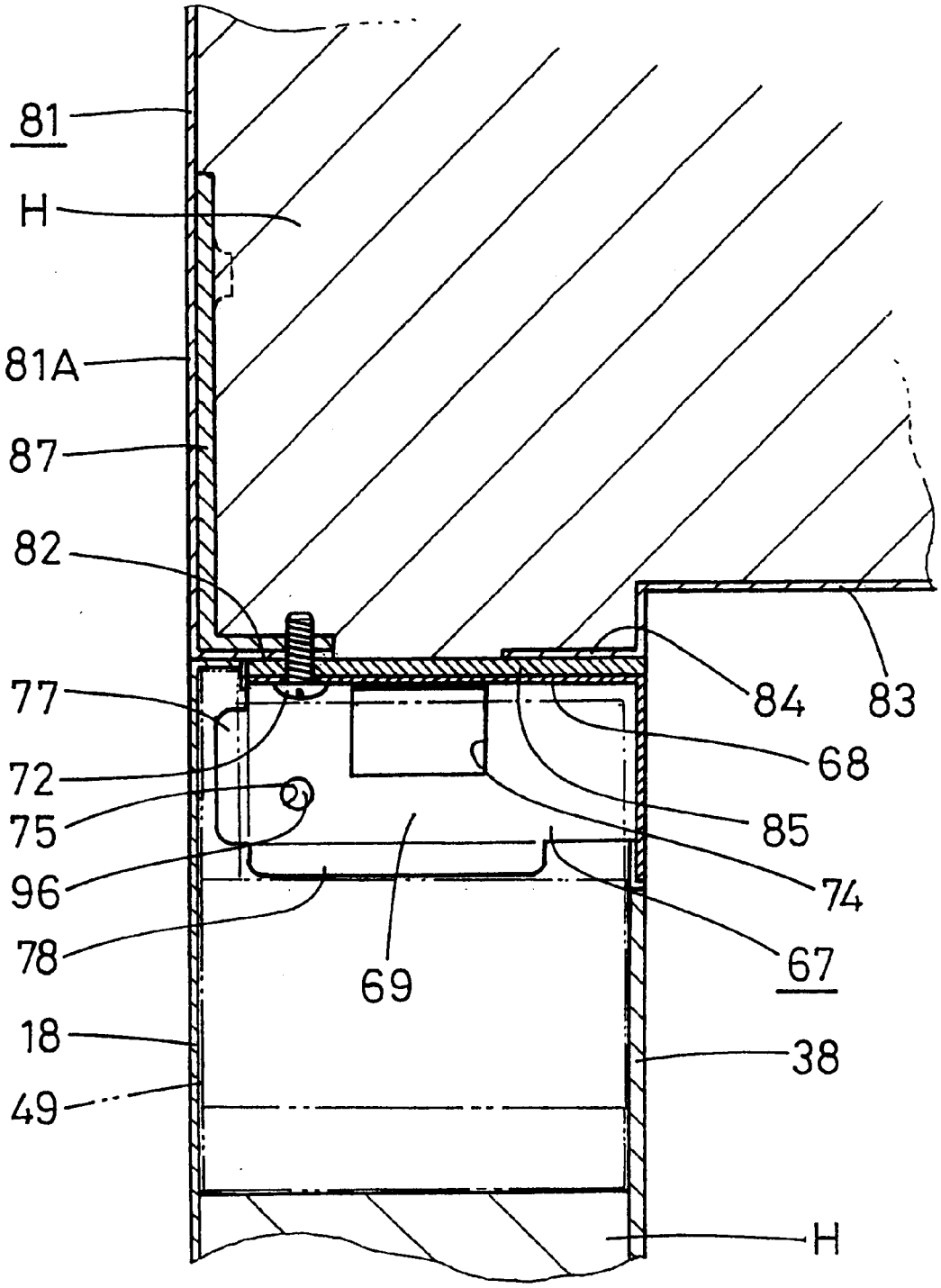
FIG. 20 is a partial sectional view of the partition frame on which the catch is mounted.

Each catch 67 will be mounted on the body 1 in the following manner. The structure of the opening 5 will first be described. The outer box 81 has an inwardly bent portion 82 formed by bending an open edge thereof inward at right angles as shown in FIG. 20. The inner box 83 has an outwardly bent portion 84 formed by bending an open edge thereof outward at right angles. The bent portions 82 and 84 are opposed to each other with a predetermined space therebetween. A joiner 85 made from a synthetic resin is provided between the bent portions 82 and 84 so as to close the space therebetween, so that the side faces of the opening 5 are formed.

Figure 21:
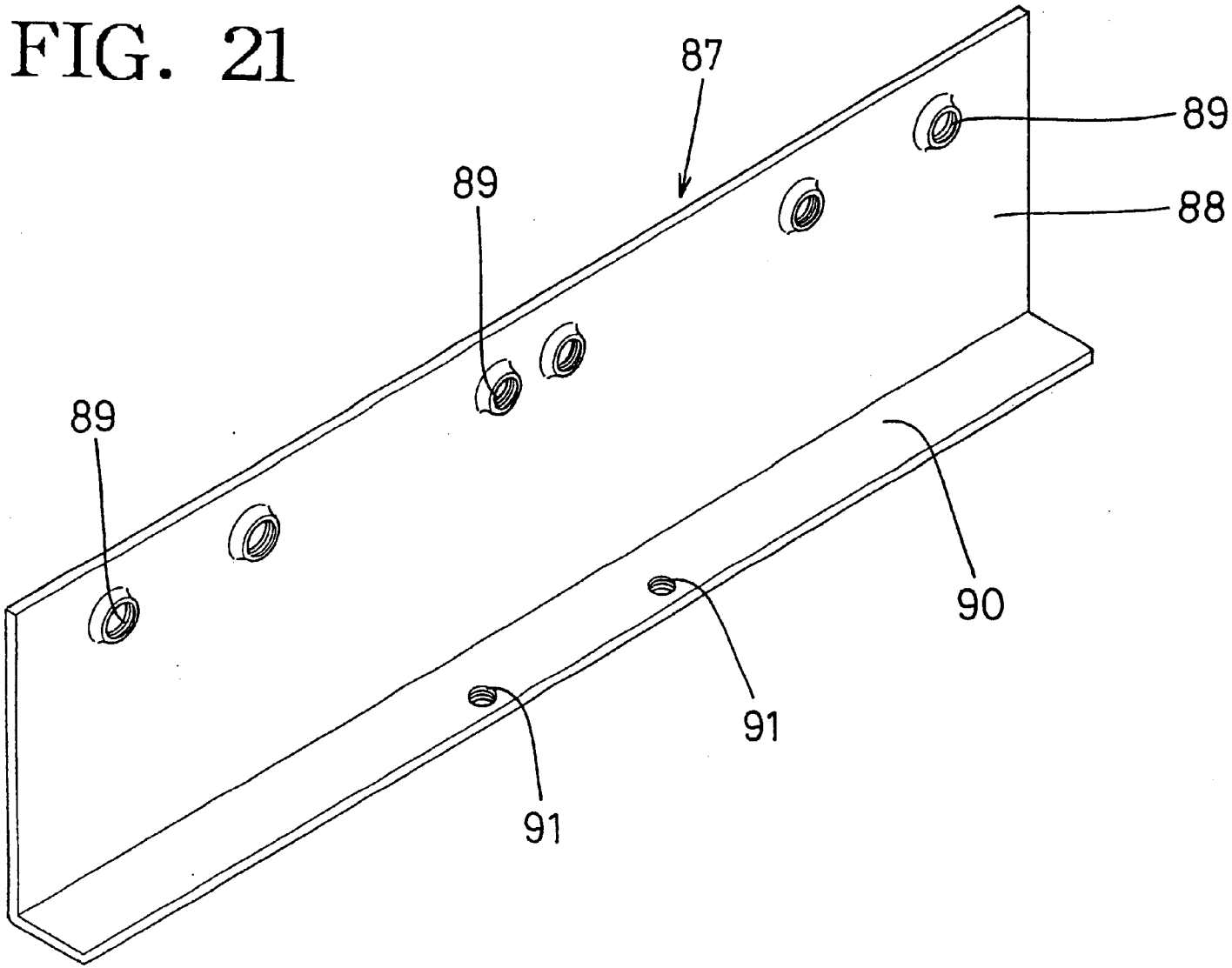
FIG. 21 is a perspective view of a reinforcing plate mounted at the body side.

A reinforcing plate 87 is provided so as to extend from a front plate 81A of the outer box 81 to the backside of the inwardly bent portion 82. For example, the reinforcing plate 87 provided on the upper edge of the opening 5 is as long as the reinforcing plate 24 provided on the partition frame 6 and has a generally L-shaped section as shown in FIG. 21. A wide portion 88 of the reinforcing plate 87 has three pairs of cylindrical portions knocked out at the backside thereof. Two pairs of the cylindrical portions are formed in both ends of the wide portion 88 respectively and the other is formed in the lengthwise central portion thereof. The cylindrical portions are formed with screw holes 89 respectively. On the other hand, a narrow portion 90 of the reinforcing plate 87 has a pair of screw holes 91 formed in the lengthwise central portion thereof. The screw holes 91 correspond to the insertion holes 73 for the screws 72 of the catch 67 respectively. The reinforcing plate 87 is abutted against the front plate 81A of the outer box 81 and the backside of the inwardly bent portion 82 and fixed to the outer box 81 by a suitable number of screws (not shown) screwed through the screw holes 89 from the front respectively. The foaming material H is supplied into the space between the outer and inner boxes 81 and 83. The mounting plate 68 of the catch 67 is abutted against the underside of the joiner 85 and the screws 72 are inserted through both insertion holes 73, the joiner 85 and the inwardly bent portion 82 into the screw holes 91 of the reinforcing plate 87, being tightened up to be fixed.

The mounting structure for the catch 67 mounted on the lower edge of the opening 5 is the same as described above. On the other hand, when the catch 67 is mounted on the left-hand or right-hand side edge of the opening 5, a shorter reinforcing plate 87A with the L-shaped section is used as shown by broken line in FIG. 18.

Figure 22:
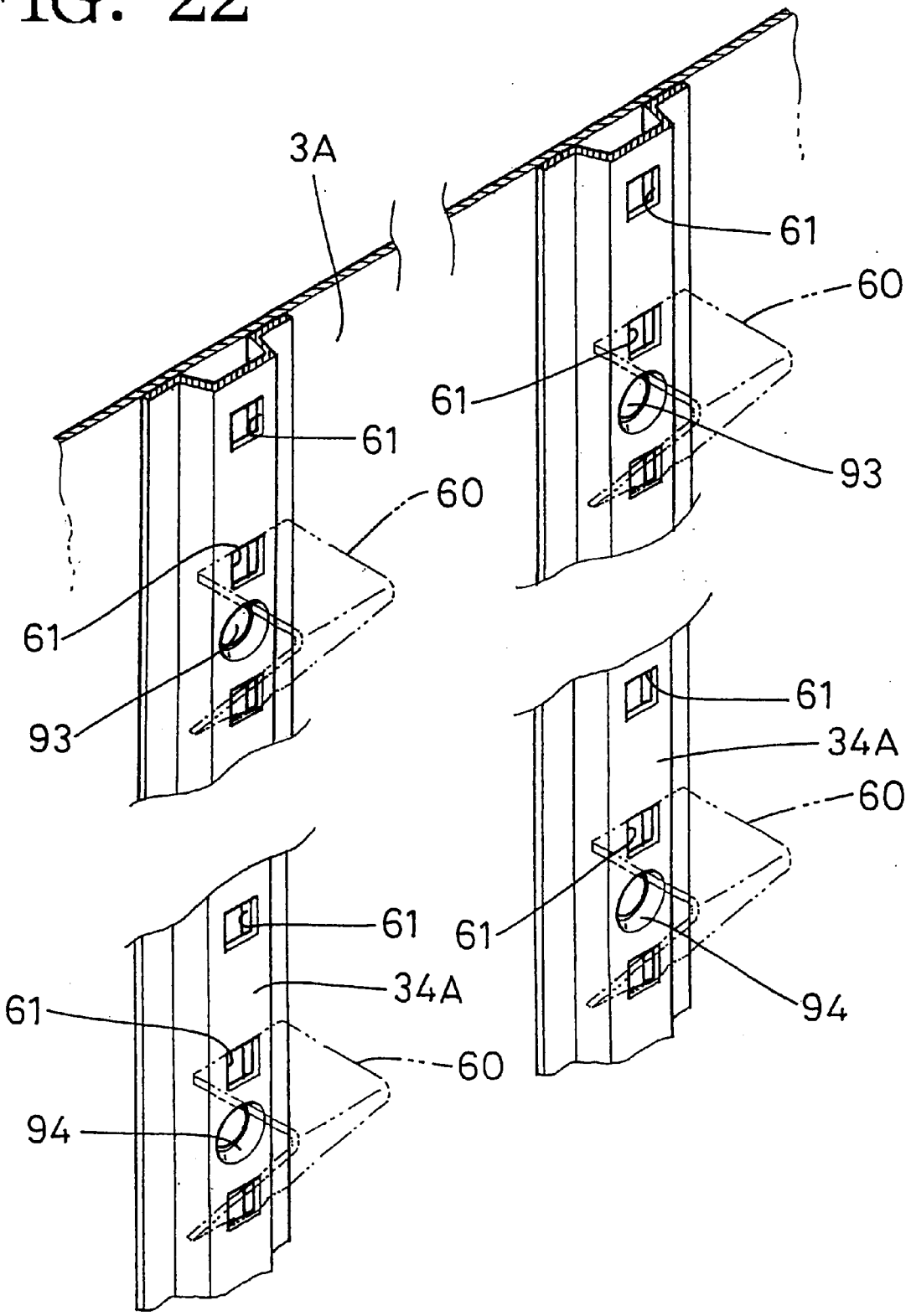
FIG. 22 is a partially eliminated perspective view showing shelf supports mounted on an inner wall of the storage compartment.

Rack supports 34A are previously mounted in the storage compartment 3. More specifically, two pairs of rack supports 34A are mounted on the left-hand and right-hand portions of the rear wall of the storage compartment 3 respectively. Two rack supports 34A are mounted on front portions of the left-hand and right-hand side walls respectively. Each rack support 34A has substantially the same basic structure as that mounted on the backside of the partition frame 6. Each rack support 34A is mounted on an inner wall 3A by rivets 93. For this purpose, the protruding portion of each rack support 34A has five depressed mounting seats 94 disposed so as to vertically divide the protruding portion into six equal parts as shown in FIG. 22. Each rack support 34A is mounted on the inner wall 3A of the storage compartment 3 by using the mounting seat 94 and the rivet 93. In this case, the position of each rivet 93 serves as a mark indicative of a standard position in the case where the rack holder 60 is attached to the rack support 34A so that the rack 15 is mounted thereon.

Returning to the description of the mounting of the partition frame 6, the upper edge of the opening 5 of the body 1 has a through hole 95 communicating with the circular hole 79 of the catch 67 and the exterior of the refrigerator as shown in FIG. 18.

The partition frame 6 assembled as described above is fitted into the opening 5 of the refrigerator body 1 in the following manner. First, the lead wires 46 of the heater 45 extended out of the upper end of the cross-shaped partition frame 6 are further drawn out through the hole 79 of the catch 67 mounted on the upper edge and the hole 95 to the top of the body 1. The upper end of the partition frame 6 is then pushed against the catch 67 of the upper edge obliquely upward so as to be obliquely fitted with the catch 67 while being guided by the first and second guides 77 and 78 of the catch 67. When the lower end of the partition frame 6 is then pushed to the side of the body 1, the left-hand and right-hand side ends of the partition frame 6 as well as the lower end thereof are fitted with the respective catches 67 while being guided by the first and second guides 77 and 78 of the respective catches 67. The partition frame 6 then assumes a vertical position such that the four ends thereof are caught by the corresponding catches 67 respectively. Subsequently, as shown in FIG. 20, the screws 96 inserted through the insertion holes 80 are screwed into the screw holes 75 of the side plates 69 of the catches 67, respectively, so that the ends of the partition frame 6 are fixed to the respective catches 67.

Thereafter, the corner covers 54 are mounted on eight corners formed by the top, bottom and two sides of the opening 5 and the ends of the partition frame 6. More specifically, the locking protrusions 55 of each corner cover 54 are inserted through the escape hole 40A of the decorative frame 37 or 38, the escape hole 30 of the frame 17 or 18 and the locking hole 74 of the catch 67 into the plug 49, so that the locking teeth 58 are engaged with the opposed edges of the holes 74 respectively such that each corner cover 54 is fixed to the respective corner. As a result, the screws 19 used to fix the frames 17 and 18 to the catches 67 respectively are concealed. The corner covers 54 are mounted on four corners of the opening 5 of the body 1 in the same manner as described above. Consequently, four access openings 7 are defined in the opening 5 of the body 1 and are arranged in two rows each of which includes two access openings. In each row, two biparting heat-insulated doors 8 are mounted on the body 1 so as to close and open the respective access openings 7.

According to the above-described embodiment, the single horizontal frame 17 is provided and the lengthwise central portion of the horizontal frame is received by the lower vertical frame 18 and hung on the upper vertical frame 18. Furthermore, the portion of the horizontal frame 17 received and hung on the respective vertical frames 18 is reinforced by the reinforcing plate 24. Consequently, the horizontal frame 17 can be reinforced against a downward load or the load applied thereto from above. Accordingly, even in a case where a heavy article is placed on the horizontal frame 17 when put into and taken out of the storage compartment 3, a sufficient strength can be obtained.

On the other hand, since the back plate 32 interconnects the divided vertical frames 18, the load is dispersively applied to the two vertical frames 18. Consequently, the vertical frames 18 can be reinforced.

The four biparting doors 8 are mounted on the body 1 in the foregoing embodiment. However, all the doors 8 need to be opened rightward or leftward depending upon the purposes of use of the refrigerator. In such a case, three hinge mechanisms are provided on the center of the partition frame 6 and the central portions of the upper and lower frames of the opening 5 of the refrigerator body 1 respectively. The reinforcing plate 24 formed with the screw holes 28 is provided in the partition frame 6, and the reinforcing plates 87 formed with screw holes 89 are provided in the frame of the opening 5. Consequently, a bracket etc. constituting each hinge mechanism can be mounted readily and stably by using the screw holes 28 and 89 of the reinforcing plates 24 and 87, respectively, when the horizontal frame and the frame of the opening 5 are drilled and when the previously tightened screws are replaced by new ones.

Several modified forms will now be described. The partition frame is assembled into the cross shape in the foregoing embodiment. One vertical frame may be mounted to the upper or lower side of the horizontal frame so that a generally T-shaped or inverted T-shaped partition frame is provided. Furthermore, a plurality of pairs of vertical frames 18 may be assembled onto the horizontal frame so that three or more access openings are defined in each row.

Although the heat-insulating material is poured into the partition frame to be foamed therein in the foregoing embodiment, the heat-insulating material may first be fitted so that the partition frame is formed.

Although the present invention is applied to the refrigerator in the foregoing embodiment, the invention may be applied to freezer-refrigerators, heating cabinets and thermo-hygrostats.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A storage apparatus comprising:

a heat-insulated housing having a front opening and a storage compartment defined therein by a ceiling, a bottom, two side walls, and a rear wall;

a partition frame mounted on said heat-insulated housing so as to partition the front opening into a plurality of access openings, said partition frame including a horizontal frame member, an upper vertical frame member, and a lower vertical frame member, wherein said horizontal frame member comprises a single member that is fixed to both of the two side walls of said heat-insulated housing so as to extend therebetween, and wherein said upper vertical frame member extends between the ceiling of said heat-insulated housing and said horizontal frame member, and said lower vertical frame member extends between the bottom of said heat-insulated housing and said horizontal frame member;

a plurality of doors mounted at the plurality of access openings, respectively; and a single back plate having sides, thereby creating a channel shape, said sides of said single back plate overlapping sides of said upper and lower vertical frame members, said single back plate being secured to said upper and lower vertical frame members so as to extend along both said upper and lower vertical frame members.

2. The storage apparatus according to claim 1, wherein said partition frame has an interior filled with a heat-insulating material.

3. The storage apparatus according to claim 1, wherein said horizontal frame member, said upper vertical frame member, and said lower vertical frame member have respective interiors filled with a heat-insulating material.

4. The storage apparatus according to claim 1, wherein said horizontal frame member is substantially U-shaped, said horizontal frame member having a first side portion, a second side portion, and a rear side portion interconnecting said first and second side portions.

5. The storage apparatus according to claim 1, wherein said upper vertical frame member has an upper end portion, said lower vertical frame member has a lower end portion, and said single back plate extends between said upper end portion of said upper vertical frame member and said lower end portion of said lower vertical frame member.

6. The storage apparatus according to claim 1, wherein each of said upper vertical frame member and said lower vertical frame member comprises a substantially U-shaped plate such that said back plate and said upper vertical frame member, and said back plate and said lower vertical frame member define interior spaces for receiving a heat-insulating material.

7. The storage apparatus according to claim 1, wherein said partition frame further includes a reinforcing member mounted at a junction between said horizontal frame member, said upper vertical frame member, and said lower vertical frame member.

8. The storage apparatus according to claim 1, further comprising a decorative frame attached to a back of said single back plate, said decorative frame comprising a single vertical decorative frame extending over backs of said upper and lower vertical frame members.

9. A storage apparatus comprising:

a heat-insulated housing having a front opening and a storage compartment defined therein by a ceiling, a bottom, two side walls, and a rear wall;

a partition frame mounted on said heat-insulated housing so as to partition the front opening into a plurality of access openings, said partition frame including a horizontal frame member, an upper vertical frame member, and a lower vertical frame member, wherein said horizontal frame member comprises a single member that is fixed to both of the two side walls of said heat-insulated housing so as to extend therebetween, and wherein said upper vertical frame member extends between the ceiling of said heat-insulated housing and said horizontal frame member, and said lower vertical frame member extends between the bottom of said heat-insulated housing and said horizontal frame member;

a plurality of doors mounted at the plurality of access openings, respectively;

a single back plate secured to said upper and lower vertical frame members so as to extend along both said upper and lower vertical frame members; and a decorative frame attached to a back of said single back plate, said decorative frame comprising a single vertical decorative frame extending over backs of said upper and lower vertical frame members.

10. A storage apparatus comprising:

a heat-insulated housing having a front opening and a storage compartment defined therein by a ceiling, a bottom, two side walls, and a rear wall;

a partition frame mounted on said heat-insulated housing so as to partition the front opening into a plurality of access openings, said partition frame including a horizontal frame member, a first vertical frame member, and a second vertical frame member, wherein said partition frame further includes a junction formed between said horizontal frame member and said first and second vertical frame members, wherein said horizontal frame member comprises a single member that is fixed to both of the two side walls of said heat-insulated housing so as to extend therebetween, said single member having abutting portions, and wherein said first vertical frame member extends between the ceiling of said heat-insulated housing and said horizontal frame member, said first vertical frame member having an abutting portion, and said second vertical frame member extends between the bottom of said heat-insulated housing and said horizontal frame member, said second vertical frame member having an abutting portion;

a plurality of doors mounted at the plurality of access openings, respectively; and a reinforcing member mounted at the junction, said reinforcing member comprising a base and two side plates raised from opposite edges of said base, respectively, and said reinforcing member having a width such that said reinforcing member fits tightly in said horizontal frame member, wherein each of said abutting portions of said horizontal frame member is sandwiched between one of said side plates of said reinforcing member and one of said abutting portions of said first vertical frame member and said second vertical frame member, respectively.

11. The storage apparatus according to claim 10, wherein said reinforcing member has a plurality of mounting holes for mounting said plurality of doors for closing and opening the respective access openings.

12. The storage apparatus according to claim 10, wherein said horizontal frame member, said first vertical frame member, and said second vertical frame member have respective interiors filled with a heat-insulating material.

13. The storage apparatus according to claim 10, wherein said horizontal frame member is substantially U-shaped, said horizontal frame member having a first side portion, a second side portion and a rear side portion interconnecting said first and second side portions.

14. The storage apparatus according to claim 13, wherein said reinforcing member is mounted on said rear side portion of said horizontal frame member at said junction.

15. The storage apparatus according to claim 14, wherein a first one of said side plates of said reinforcing member has a height that is smaller than a first one of said side portions of said horizontal frame member and a second one of said side plates of said reinforcing member has a height that is substantially equal to a second one of said side portions of said horizontal frame member.

16. The storage apparatus according to claim 10, further comprising a back plate connected to said first and second vertical frame members, wherein said first vertical frame member has an upper end portion, said second vertical frame member has a lower end portion, and said back plate extends between said upper end portion of said first vertical frame member and said lower end portion of said second vertical frame member.

17. The storage apparatus according to claim 16, wherein said first and second vertical frame members are substantially U-shaped so that said back plate and said first and second vertical frame members define an interior space for receiving a heat-insulating material.

18. The storage apparatus according to claim 10, wherein said partition frame has an interior filled with a heat-insulating material.

* * * * *